US009644882B2

(12) United States Patent
Tansley

(10) Patent No.: US 9,644,882 B2
(45) Date of Patent: May 9, 2017

(54) REFRIGERATION APPARATUS AND METHOD

(71) Applicant: The Sure Chill Company Limited, Tywyn, Gwynedd (GB)

(72) Inventor: Ian Tansley, Tywyn (GB)

(73) Assignee: THE SURE CHILL COMPANY LIMITED, Cardiff (GB)

( * ) Notice: Subject to any disclaimer, the term of this patent is extended or adjusted under 35 U.S.C. 154(b) by 0 days.

(21) Appl. No.: 15/003,386

(22) Filed: Jan. 21, 2016

(65) Prior Publication Data

US 2016/0216023 A1 Jul. 28, 2016

Related U.S. Application Data

(63) Continuation of application No. PCT/GB2014/052255, filed on Jul. 23, 2014.

(30) Foreign Application Priority Data

Jul. 23, 2013 (GB) ..... 1313154.5
Jul. 30, 2013 (GB) ..... 1313633.8

(51) Int. Cl.
*F25D 25/00* (2006.01)
*F25D 11/00* (2006.01)
(Continued)

(52) U.S. Cl.
CPC ..... *F25D 11/003* (2013.01); *F25D 3/06* (2013.01); *F25D 17/02* (2013.01)

(58) Field of Classification Search
CPC . F25D 11/003; F25D 3/00; F25D 3/02; F25D 3/08; F25D 17/02; F25D 3/06
See application file for complete search history.

(56) References Cited

U.S. PATENT DOCUMENTS 1,186,200 A 1/1877 Crisfield
1,594,015 A 7/1926 McLaughlin
(Continued)

FOREIGN PATENT DOCUMENTS

CN 2062629 U 9/1990
CN 2162269 Y 4/1994
(Continued)

OTHER PUBLICATIONS

Colombian Examination Report for Colombian Application No. 14-163243 with International filing date of Jan. 28, 2013; Mailed Jul. 14, 2015.
(Continued)

*Primary Examiner* — Elizabeth Martin
(74) *Attorney, Agent, or Firm* — Perkins Coie LLP

(57) ABSTRACT

The disclosure describes a refrigeration device. The refrigeration device includes a cold store, positioned next to a reservoir having a head region and a body region, and a payload space positioned next to the reservoir opposite the cold store. The reservoir includes a cooling fluid (in many cases, water). A cooling element in the cold store absorbs heat from fluid contained in the head region of the reservoir. The fluid in the head region cools the fluid in the body region, which in turn cools the payload. In some embodiments, the body region has a greater volume than the head region which in turn increases the thermal resistance of the body region. The refrigeration device, once at an in use equilibrium, is resistant to temperature change in a payload container. The stable temperature is maintained at a critical temperature of the cooling fluid—the critical temperature being a temperature wherein the cooling fluid is of lower density both above and below the critical temperature. The natural critical temperature for water is 4 degrees Celsius.

19 Claims, 6 Drawing Sheets

(51) Int. Cl.
*F25D 3/06* (2006.01)
*F25D 17/02* (2006.01)

(56) References Cited

U.S. PATENT DOCUMENTS

| | | | | |
|---|---|---|---|---|
| 1,988,549 | A | 1/1935 | Gibson | |
| 2,046,967 | A | 7/1936 | Post, Jr. et al. | |
| 2,641,109 | A | 6/1953 | Muffly | |
| 3,609,991 | A | 10/1971 | Chu et al. | |
| 4,498,312 | A | 2/1985 | Schlosser | |
| 4,509,587 | A | 4/1985 | Clark et al. | |
| 4,715,195 | A | 12/1987 | Kucza | |
| 4,958,506 | A | 9/1990 | Guilhem et al. | |
| 5,129,238 | A | 7/1992 | Schwartz et al. | |
| 5,237,835 | A | 8/1993 | Brochier | |
| 5,379,596 | A | 1/1995 | Grayson | |
| 5,408,845 | A | 4/1995 | Clark et al. | |
| 5,627,310 | A | 5/1997 | Johnson | |
| 5,782,095 | A | 7/1998 | Chen | |
| 6,314,751 | B1 | 11/2001 | Gjersvik | |
| 6,415,624 | B1 | 7/2002 | Connors et al. | |
| 6,469,487 | B2 | 10/2002 | Ewert et al. | |
| 6,698,210 | B2 | 3/2004 | Ogura et al. | |
| 7,055,575 | B2 | 6/2006 | Noel | |
| 7,543,455 | B1 | 6/2009 | Chen | |
| 8,215,125 | B2 | 7/2012 | Linder | |
| 8,424,335 | B2 | 4/2013 | Corder et al. | |
| 8,516,849 | B2 | 8/2013 | Mooijer et al. | |
| 8,640,487 | B2 | 2/2014 | Chapa | |
| 2002/0050147 | A1* | 5/2002 | Mai | F25D 3/08 62/457.2 |
| 2002/0104318 | A1 | 8/2002 | Jaafar et al. | |
| 2003/0070436 | A1 | 4/2003 | Wood et al. | |
| 2004/0123620 | A1 | 7/2004 | Porter | |
| 2005/0229626 | A1 | 10/2005 | Akopyan | |
| 2006/0174648 | A1 | 8/2006 | Lantz | |
| 2006/0230778 | A1 | 10/2006 | Williams | |
| 2008/0060374 | A1 | 3/2008 | Gammons et al. | |
| 2008/0092559 | A1 | 4/2008 | Williams et al. | |
| 2008/0135564 | A1 | 6/2008 | Romero | |
| 2008/0141875 | A1 | 6/2008 | Fahrenback | |
| 2009/0151368 | A1 | 6/2009 | Bar | |
| 2010/0018221 | A1 | 1/2010 | Flinner et al. | |
| 2010/0102057 | A1 | 4/2010 | Long et al. | |
| 2010/0293970 | A1 | 11/2010 | Mooijer et al. | |
| 2011/0120151 | A1 | 5/2011 | Cutting et al. | |
| 2012/0102994 | A1* | 5/2012 | Tansley | F25D 16/00 62/235.1 |
| 2014/0360214 | A1 | 12/2014 | Tansley | |
| 2016/0018151 | A1 | 1/2016 | Tansley | |
| 2016/0152402 | A1 | 6/2016 | Su | |
| 2016/0243000 | A1 | 8/2016 | Gray | |

FOREIGN PATENT DOCUMENTS

| | | | |
|---|---|---|---|
| CN | 1097505 | A | 1/1995 |
| CN | 1133631 | A | 10/1996 |
| CN | 2379760 | Y | 5/2000 |
| CN | 1893863 | A | 1/2007 |
| CN | 201451827 | U | 5/2010 |
| DE | 3627201 | A1 | 4/1987 |
| DE | 4142842 | A1 | 4/1993 |
| DE | 4425213 | A1 | 1/1996 |
| EP | 0038864 | A1 | 11/1981 |
| EP | 491671 | A1 | 6/1992 |
| EP | 0491671 | A1 | 6/1992 |
| EP | 505208 | A2 | 9/1992 |
| EP | 1538409 | A2 | 6/2005 |
| FR | 2537712 | A1 | 6/1984 |
| FR | 2562218 | A1 | 10/1985 |
| GB | 165684 | A | 7/1921 |
| GB | 494531 | A | 10/1938 |
| GB | 1429678 | A | 3/1976 |
| GB | 2235968 | A | 3/1991 |
| GB | 2281773 | A | 3/1995 |
| GB | 2430724 | A | 4/2007 |
| GB | 2457054 | A | 8/2009 |
| GB | 2471865 | A | 1/2011 |
| JP | H05-79741 | A | 3/1993 |
| JP | 10144361 | A | 5/1998 |
| JP | 2001133109 | A | 5/2001 |
| JP | 2001221553 | A | 8/2001 |
| JP | 2001227847 | A | 8/2001 |
| JP | 2002013855 | A | 1/2002 |
| JP | 2003148849 | A | 5/2003 |
| JP | 2004043020 | A | 2/2004 |
| SU | 898226 | A1 | 1/1982 |
| WO | 0218210 | A1 | 3/2002 |
| WO | 2009005008 | A1 | 1/2009 |
| WO | 2009072876 | A1 | 6/2009 |
| WO | 2010086167 | A1 | 8/2010 |
| WO | 2011007162 | A2 | 1/2011 |
| WO | 2013089678 | A1 | 6/2013 |

OTHER PUBLICATIONS

Colombian Examination Report for Colombian Application No. 15-202569 with International filing date of Jan. 28, 2014; Mailed Sep. 9, 2016.

Exam Report for Egyptian Application EG2012010066 filed Dec. 1, 2012; 7 pages.

Exam Report for Egyptian Application EG2014071169, mail date Aug. 1, 2016; 7 pages.

Examination Report for Canadian Application No. 2,767,864, mail date May 13, 2016, 4 pages.

Examination Report for United Kingdom Patent Application No. GB1201437.9, mail date Apr. 7, 2014, 2 pages.

Final Office Action mailed Aug. 29, 2016, for U.S. Appl. No. 13/383,118, of Tansley, Ian filed Jan. 9, 2012.

Final Office Action mailed Nov. 5, 2014, for U.S. Appl. No. 13/383,118, of Tansley, Ian filed Jan. 9, 2012.

First Office Action mailed Apr. 21, 2016, for Eurasian Patent Application No. 201491428, 5 pages.

First Office Action mailed Dec. 26, 2014, for Eurasian Patent Application No. 201270161.

First Office Action mailed Jun. 2, 2015, for Japanese Patent Application No. 2012-520097.

First Office Action mailed Mar. 25, 2015, for Vietnamese Patent Application No. 1-2012-00156.

First Office Action mailed Nov. 12, 2014, for Mexican Patent Application No. MX/A/2012/000719.

First Office Action mailed Nov. 6, 2015 for Chinese Patent Application No. 201380017447.3, 66 pages, with English Translation.

First Office Action mailed Sep. 5, 2014, for Phillipines Patent Application No. 12012500102.

Great Britain Examination Report for GB Application 1401455.9; Mail Date Sep. 15, 2014.

International Search Report and Written Opinion mailed Apr. 4, 2011, for International Patent Application No. PCT/GB2010/051129 filed Jul. 9, 2010.

International Search Report and Written Opinion mailed May 6, 2015, for International Patent Application No. PCT/GB2014/050218 filed Jan. 28, 2014.

International Search Report and Written Opinion mailed Sep. 26, 2014, for International Patent Application No. PCT/GB2014/052255 filed Jul. 23, 2014.

Non-Final Office Action mailed Jul. 14, 2015, for U.S. Appl. No. 13/383,118, of Tansley, Ian filed Jan. 9, 2012.

Non-Final Office Action mailed Mar. 12, 2014, for U.S. Appl. No. 13/383,118, of Tansley, Ian filed Jan. 9, 2012.

Office Action in Eurasian Patent Application No. 201591385/31, mail date Aug. 30, 2016, 6 pages.

Office Action in Thailand Patent Application No. 1401004332, mail date May 28, 2015, 1 page.

Patent Examination Report No. 1 for Australian Application No. 2015202391, mail date May 2, 2016, 3 pages.

Restriction Requirement mailed Dec. 31, 2013, for U.S. Appl. No. 13/383,118, of Tansley, Ian filed Jan. 9, 2012.

(56) References Cited

OTHER PUBLICATIONS

Second Office Action mailed Apr. 3, 2015, for Eurasian Patent Application No. 201270161.
Second Office Action mailed Aug. 26, 2016 for Chinese Patent Application No. 201380017447.3, 37 pages, with English Translation.
Second Office Action mailed Aug. 4, 2015, for Japanese Patent Application No. 2012-520097.
Second Office Action mailed Jul. 1, 2015, for Mexican Patent Application No. MX/A/2012/000719.
Second Office Action mailed Jun. 1, 2015, for Phillipines Patent Application No. 12012500102.
Substantive Search and Examination Report mailed May 11, 2014, for ARIPO Application No. AP/P/2012/006111 filed Sep. 7, 2010, 32 pages.
Substantive Search and Examination Report mailed May 11, 2014, for ARIPO Application No. AP/P/2014/007819 filed Jan. 28, 2013, 4 pages.
Third Office Action mailed Mar. 28, 2016, for Eurasian Patent Application No. 201270161, 4 pages.
Final Office Action mailed Feb. 5, 2016 in U.S. Appl. No. 13/383,118 of Tansley, I. filed Jan. 9, 2012.
Non-Final Office Action mailed May 12, 2016 in U.S. Appl. No. 13/383,118 of Tansley, I. filed Jan. 9, 2012.
Examination Report mailed Feb. 21, 2017 in Canadian Application No. 2,767,864, 3 pages.
Examination Report issued Jan. 5, 2017 in Egyptian Patent Application No. 2012010066, with English translation, 7 pages.
Second Office Action mailed Dec. 21, 2016 in Eurasian Patent Application No. 201491428/31, with English translation, 3 pages.
International Search Report and Written Opinion PCT/US16/51273 dated Jan. 26, 2017, pp. 1-10.
Non-Final Office Action mailed Jan. 31, 2017 in U.S. Appl. No. 15/262,486 of Tansley, I. filed Sep. 12, 2016.
Restriction Requirement mailed Jan. 4, 2017 in U.S. Appl. No. 14/373,580 of Tansley, I. filed Jul. 21, 2014.
First Office Action issued Nov. 28, 2016 in Chinese Patent Application No. 201510186465.5, with English translation, 20 pages.
Examination Report mailed Oct. 19, 2016 in European Patent Application No. 10739675.6, 5 pages.
Notice of Allowance mailed Dec. 2, 2016 in U.S. Appl. No. 13/383,118 of Tansley, Ian filed Jan. 9, 2012.
U.S. Appl. No. 15/262,486 of Tansley, I. filed Sep. 12, 2016.

* cited by examiner

REFRIGERATION APPARATUS AND METHOD

CLAIM OF PRIORITY

This application is a continuation application of International Application No. PCT/GB2014/052255 filed Jul. 23, 2014, which claims priority to Great Britain patent application nos. GB 1313154.5 filed Jul. 23, 2013 and GB 1313633.8 filed Jul. 30, 2013, all of which are hereby incorporated by reference in their entirety.

FIELD OF THE INVENTION

The present invention relates to a refrigeration apparatus. In particularly, but not exclusively, the invention relates to a refrigeration apparatus for use in storing and transporting vaccines, perishable food items, packaged beverages or the like, and for the cooling or temperature control of equipment such as batteries, in the absence of a reliable supply of electricity. Aspects of the invention relate to an apparatus and to a method.

BACKGROUND

A large proportion of the world's population does not have access to a consistent and reliable supply of mains electricity. Underdeveloped countries, or regions remote from populated areas, frequently suffer from rationing of electrical power, often implemented by means of "load shedding", being the creation of intentional power outages, or failures of the distribution network.

The storage of vaccines, food items and beverages at appropriate temperatures is difficult in such areas where this absence of a constant and/or reliable supply of electrical power restricts the widespread use of conventional refrigeration equipment. Vaccines, for example, are required to be stored within a narrow temperature range between approximately 2-8° C., outside of which their viability can be compromised or destroyed. Similar problems arise in connection with the storage of food, particularly perishable food items, and packaged beverages such as canned or bottled drinks.

In response to this problem, the present applicants have previously proposed a form of refrigeration apparatus, disclosed in international patent application no. PCT/GB2010/051129, which permits a refrigerated storage space to be maintained within a temperature range of 4-8° C. for up to 30 days following a loss of electrical power. This prior art apparatus comprises a payload space for vaccines, food items, drinks containers or any other item to be cooled, the payload space being disposed at a lower region of a thermally insulated reservoir of water. Above the reservoir, and in fluid communication therewith, a water-filled head space containing a cooling element or low-temperature thermal mass, provides a supply of cold water to the reservoir.

This prior art apparatus relies upon the known property that water is at its maximum density at approximately 4° C. Thus, water cooled to this temperature by the cooling element or thermal mass in the head space tends to sink down into the reservoir, settling at the lower region surrounding the payload space which, through thermal transfer, is cooled to a temperature at or close to 4° C.

The applicants have identified a need to improve on the above mentioned apparatus to facilitate packaging, transportation and efficiency in some applications. It is against this background that the present invention has been conceived. Other aims and advantages of the invention will become apparent from the following description, claims and drawings.

STATEMENT OF INVENTION

Aspects of the invention therefore provide an apparatus and a method as claimed in the appended claims.

In one aspect of the invention for which protection is sought there is provided cooling apparatus comprising:

a cold store portion for storing at least one cooling object;

a fluid reservoir for holding fluid to be cooled, the reservoir having a head region and a body region below the head region each arranged to contain fluid to be cooled;

a cold store heat exchange portion arranged in use to be provided in thermal communication with a cooling object in the cold store portion and fluid in the head region of the fluid reservoir and not fluid below the head region, the cold store portion and fluid reservoir being provided in a side by side configuration; and a second heat exchange portion arranged in use to be provided in thermal communication with fluid in the body region such that heat may flow from a heat source to fluid in the body region, wherein in use cooling of fluid in the head region by a cooling object in the cold store portion causes cooling of fluid in the body region and thereby cooling of the second heat exchange portion.

It is to be understood that cooling of fluid in the head region may cause cooling of fluid in the body region by conduction of heat at least in part from the body region to the head region. In addition or instead, in some embodiments cooling of fluid in the head region may cause fluid in the head region to become less buoyant and sink towards the body region. This may cause cooling of fluid in the body region and/or fluid in the body region to rise towards the head region where the fluid may be cooled.

The head and body regions may be in fluid communication with one another in some embodiments. Thus, fluid in the head region that is cooled by the cold store heat exchange portion may sink into the body region, causing cooling of the body region and in turn cooling of the second heat exchange portion. Alternatively or in addition, a substantially static equilibrium may be established in which little or no movement of fluid takes place, thermal transfer between the body and head regions taking place by conduction through the fluid.

Embodiments of the present invention allow cooling apparatus to be provided that is driven by one or more cooling objects such as one or more cold packs or loose frozen material such as water ice or dry ice (frozen carbon dioxide) provided in the cold store portion. The cooling object drives cooling of fluid in the fluid reservoir in an upper (head) region thereof.

The one or more cold packs may be cooled to any suitable temperature, either before being introduced into the cold store portion or after being introduced, for example by means of powered cooling means such as a refrigeration unit arranged to cool the cold store portion. In some embodiments the cold packs may be cooled to a temperature in the range from −20 C to −5 C before or after being introduced into the cold store portion. Other temperatures are useful such as temperatures down to −25 C, or down to lower temperatures such as −30 C, −40 C, −50 C or any other suitable temperature. It is to be understood that the skilled person will be able to determine, by experiment, a suitable range of temperatures for cold packs to allow cooling of fluid in the head region to a sufficiently low temperature. In some embodiments, overcooling of fluid in the head region may result in overcooling of fluid in the body region and potentially result in overcooling of the second heat exchange portion. Accordingly the skilled person may adjust one or more parameters associated with the design of the apparatus such as the volume of the cold store portion, the volume of the fluid reservoir, the relative sizes of the head and body regions, the width, depth and/or height of the reservoir, a surface area of the cold store heat exchange portion that is in substantially direct thermal and/or fluid contact with fluid in the head region, and/or one or more other parameters in addition or instead. It is to be understood that if the fluid in the fluid reservoir comprises water and water in the body region freezes this may in some embodiments cause overcooling of the second heat exchange portion. The skilled person may therefore design the apparatus such as freezing of water in the body region does not occur in use, or does not occur following stabilisation of the apparatus after initially cooling of water in the reservoir from ambient temperature. Other arrangements may be useful, and other criteria in designing the apparatus for a given application.

It is to be understood that if the fluid in the fluid reservoir has a negative to positive critical temperature of thermal expansion such as water, being a temperature above which the fluid exhibits a positive coefficient of thermal expansion and below which the fluid exhibits a negative coefficient of thermal expansion, then the apparatus may be operable to maintain fluid in the fluid reservoir at a given depth below the head region (within the body region) at a substantially constant temperature that is at least in part dependent on the negative to positive critical temperature.

It is to be understood that as a temperature of fluid in the head region falls due to cooling by the heat exchange portion, the temperature of the fluid approaches the critical temperature at which a density of the fluid is a maximum, causing the fluid to become less buoyant and to sink, whilst as the temperature of the fluid rises above the critical temperature, the density of the fluid decreases and the fluid, being more buoyant, tends to rise. Rising fluid at a temperature above the critical temperature mixes with sinking fluid, and ultimately a substantially static equilibrium may be established in some arrangements. Fluid in the head region that is cooled below the critical temperature has a density less than fluid at the critical temperature and therefore tends not to sink below the head region. Thus the temperature of fluid in the body region below the head region can be arranged in some embodiments not to rise substantially above the critical temperature or to fall substantially below the critical temperature.

Advantageously the critical temperature is in the range from −100° C. to +50° C., further advantageously in the range from −50° C. to 10° C., still further advantageously in the range from −20° C. to around 8° C., advantageously in the range from −20° C. to 5° C., further advantageously in the range from −5° C. to 5° C. Other values are also useful.

It is to be understood that by cold pack is meant a body of coolant contained within a sealed package, such as an icepack. The package may comprise a plastics material. The coolant may comprise water, a water/salt mixture such as a water/salt solution, a water/solvent mixture, a gel, or any other suitable coolant. As noted above, frozen coolant in loose form such as blocks, granules, 'ice cubes', crushed frozen coolant or any other suitable form may also be used.

Optionally, the second heat exchange portion and cold store portion are provided on substantially opposite sides of the reservoir.

The apparatus may be arranged wherein in use the second heat exchange portion is provided in substantially direct thermal contact with fluid in the fluid reservoir below the head region and not with fluid within the head region.

Thus the second heat exchange portion may be provided in substantially direct thermal contact with fluid in the body region of the reservoir and not with fluid within the head region. This feature enables overcooling of the second heat exchanger to be prevented. It is to be understood that in the case that a thermal fluid having a critical temperature is employed, the critical temperature being a temperature above which the fluid exhibits a positive coefficient of thermal expansion and below which the fluid exhibits a negative coefficient of thermal expansion, fluid at or around the critical temperature may be arranged to pool in the body region in use, enabling the second heat exchange portion to be cooled to a temperature substantially equal to the critical temperature.

It is to be understood that although the second heat exchange portion may not be in substantially direct thermal communication with fluid in the head region, the second heat exchange portion may be in thermal communication with fluid in the head region via fluid in the body region. Thus, thermal energy may pass from the body region to the head region by conduction.

The apparatus may further comprise a payload container, wherein in use the second heat exchange portion is arranged to allow flow of thermal energy from an interior volume of the payload container to fluid in the body region of the fluid reservoir.

The payload container may comprise the second heat exchange portion. A wall of the payload container may provide the second heat exchange portion in some embodiments.

The second heat exchange portion may comprise a pipe arranged to allow a fluid to be cooled to flow therethrough.

This feature may be useful in applications where a fluid is to be cooled such as in beverage dispensing applications. For example, in some embodiments the apparatus may be arranged to form part of an in-line beverage or other liquid dispensing assembly, the apparatus being arranged to cool liquid on demand, for example when a tap or the like is opened to allow flow of fluid from a fluid source such as a water supply or beverage container, through the pipe of the second heat exchange portion and out from the tap.

Optionally, the cold store heat exchange portion is arranged in use to be provided in substantially direct thermal contact with a cooling object in the cold store portion.

Optionally, the cold store heat exchange portion comprises or provides a portion of a wall defining an outer boundary of the fluid reservoir.

It is to be understood that by wall of the fluid reservoir is meant a portion defining a boundary of the reservoir and arranged to retain fluid within the reservoir.

It is to be understood that in some embodiments the cold store portion is not a portion that is intended to be filled with liquid, and operation of the apparatus does not require that this is the case. The cold store portion may be considered to be a dry storage portion although it may become at least partially filled with liquid due to condensation or melting of loose frozen coolant such as ice.

Drain means may be provided for allowing any liquid in the cold store portion to drain from the cold store portion, optionally during use of the apparatus.

In some embodiments, the cold store heat exchange portion may be provided by a wall of the cold store portion and/or a wall of the reservoir. It is to be understood that a single wall may divide the cold store portion from fluid in the fluid reservoir. The wall may present a relatively low resistance to thermal transfer between fluid in the head region of the reservoir and one or more cooling objects in the cold store portion, whilst the wall may present a relatively high resistance to thermal transfer between fluid in the body region of the reservoir and one or more cooling objects in the cold store portion.

In some embodiments, a thermally insulating portion may be provided between the cold store portion and fluid in the body region of the reservoir. In some embodiments the thermally insulating portion may comprise a layer of a thermally insulating material. In some embodiments the thermally insulating portion may be realised at least in part by forming a wall dividing the cold store portion and reservoir to be of greater thickness between the body region of the reservoir and the cold store portion relative to that between the head region of the reservoir and the cold store portion.

Optionally, the cold store heat exchange portion comprises a portion that is provided in substantially direct thermal contact with the wall of the reservoir.

Optionally, the cold store heat exchange portion comprises at least one cold store heat exchange element configured in use to be provided in substantially direct thermal contact with a cooling object such as a cold pack in the cold store portion.

It is to be understood that substantially direct thermal contact between the cold store heat exchange element includes direct physical (touching) contact and direct contact via fixing means such as a weld or a fixing element such as a bolt, a rivet or other fixing element. One or more intermediate elements may be provided such as a washer, a gasket or other suitable member intermediate the cold store heat exchange element and the wall of the reservoir.

The cold store heat exchange element may comprise a metallic element, formed from a metal having a relatively high thermal conductivity such as copper or aluminium. The element may be formed from a ferrous metal such as a stainless steel having inherent corrosion resistance and/or a corrosion resistant coating such as a waterproof paint or other coating.

The at least one cold store heat exchange element may be arranged to extend to a lower region of the cold store portion such that in use the heat exchange element may be provided in thermal contact with a cooling object provided in the lower region thereof.

The at least one cold store heat exchange element may be arranged to extend to a lower region of the cold store portion such that in use the heat exchange element may be provided in thermal contact with a cooling object resting on a basal surface of the cold store portion.

Optionally, the at least one cold store heat exchange element is arranged to extend to a lower region of the cold store portion and across at least a portion of a basal surface thereof such that in use a cooling object may rest on the heat exchange element.

Optionally, the cold store portion is sized to receive a plurality of cold packs. The cold packs may be of any suitable dimensions, for example around 15 cm×2 cm×8 cm or any other suitable dimensions. The cold store portion may be of any suitable size, such as 300 mm wide by 300 mm deep by 300 mm high or any other suitable size.

The fluid reservoir may be of any suitable size such as 300 mm wide by 10 cm deep by 300 mm high. Thus a distance between a dividing wall between the cold store portion and the reservoir, and dividing wall between the reservoir and payload container, may be around 10 cm. Other dimensions are also useful such as 5 cm, 15 cm, 20 cm, 30 cm or any other suitable dimension.

It is to be understood that the relative volumes of the head region and body region may be of any suitable proportion. In an embodiment the head region occupies approximately 10% of the fluid-filled volume of the reservoir and the body region occupies approximately 90% of the fluid-filled volume. Thus the ratio of the volume of the head region to the body region is 10:90 in some embodiments. It is to be understood that the ratio may be any suitable ratio and an optimum ratio may be determined empirically by the skilled person. Other suitable ratios include ratios of around 20:80, 30:70, 40:60 and 50:50. Other ratios may be useful in some embodiments depending on the application. It is to be understood that in some applications of embodiments of the present invention, the consequences of overcooling of the second heat exchange portion may be less severe than others, allowing overcooling to be tolerated to a greater extent in some embodiments.

The apparatus may comprise resilient urging means for maintaining a cooling object in substantially direct thermal contact with the cold store heat exchange portion.

This feature has the advantage that a change in volume of a cooling object due to warming thereof in use may be accommodated by the resilient urging means such that a cooling article that is initially in substantially direct thermal contact with the cold store heat exchange portion does not move out of such contact during warming. For example, in the case the cooling article is a cold pack that shrinks (or expands) on warming, the cooling article may be maintained in contact with the cold store heat exchange portion even as it shrinks or expands.

The urging means may comprise a resilient member and a cooling object contact portion, the resilient member being arranged to cause the contact portion to apply a force to a cooling object to urge the cooling object in a direction toward the cold store heat exchange portion.

The contact portion may form part of the resilient member, for example a free end thereof. This feature may be advantageous in reducing seizure of the resilient member due to formation of frozen water ice thereon, for example due to freezing of condensed water vapour.

Where a plurality of cold packs are provided side by side in the cold store portion, the resilient urging means may apply a force to one cold pack that is transmitted to a cold pack nearest the cold store heat exchange portion to maintain that cold pack in substantially direct thermal contact with the cold store heat exchange portion.

Advantageously the contact portion may be movable such that the resilient urging means is operable to accommodate different numbers of cooling articles.

In some embodiments the resilient urging means is formed to be of relatively high thermal conductivity whilst in some alternative embodiments the resilient urging means is formed to be of relatively low thermal conductivity.

In some embodiments the resilient urging means may comprise a resiliently deformable object such as a helical spring, leaf spring or other spring element. In addition or instead the resilient urging means may comprise a resiliently deformable article or material such as a sponge-like material, gas or fluid-filled bladder or any other suitable means. The resilient urging means may be arranged to adapt its shape or size to accommodate variations in the volume or position of one or more cooling articles such as cold packs or loose frozen coolant as the cooling articles change temperature.

In some embodiments the resilient urging means may be formed from a thermally insulating material.

In some embodiments the resilient urging means may comprise a sponge or other foam-like or foamed material that is arranged to be compressed when the cold packs are in a frozen state, and to expand as the cold packs contract.

It is to be understood that, when a given volume of frozen water melts, the volume of the water contracts. In an embodiment, resilient urging means or other means may be provided that is configured to expand when loose frozen coolant melts so as to cause a liquid level of melted coolant to rise as the coolant melts. Frozen coolant may in some systems float at an upper level of the liquid (as in the case of water ice in water due to a lower density of the frozen coolant relative to liquid phase coolant). The resilient urging means or other means may therefore serve the function of causing remaining frozen coolant to be positioned at a higher level within the cold store portion than would otherwise be assumed. This may have the advantage of improving thermal communication between the frozen coolant and fluid in the head region of the reservoir. This may assist in reducing an amount of any reduction in cooling of fluid in the head region of the fluid reservoir as frozen coolant in the cold store portion melts.

In some embodiments, the resilient urging means comprises a resilient member arranged to cause a force to be applied to a cooling object to urge the cooling object in a direction toward the cold store heat exchange portion.

Optionally, the resilient urging means is arranged to cause a force to be applied to a cooling object by means of a contact portion arrange to contact the cooling object, the contact portion being movable such that the resilient urging means is operable to accommodate different numbers or sizes of cooling articles.

In some embodiments a thermal resistance of the apparatus to flow of heat from fluid in the fluid reservoir to the cold store portion is higher for fluid below the head region compared with fluid in the head region.

Optionally, the fluid storage reservoir comprises a plurality of fluid-filled cells in thermal contact with one another, each cell comprising fluid contained within a cell wall portion, the cell wall portions of respective adjacent cells being arranged to allow transfer of thermal energy between fluid in respective adjacent cells in thermal contact.

The use of fluid-filled cells in the fluid storage reservoir has the advantage in some embodiments that movement of fluid in the reservoir during handling or transport of the apparatus may be restricted, reducing a risk that overcooling of the second heat exchange portion occurs. It is to be understood in the case that the thermal fluid is or comprises water, having a critical temperature of around 4 C, water in the head space may be at a temperature of 1-2 C. If this water mixes with water below the head region that is in thermal communication with the second heat exchange portion, the second heat exchange portion may be cooled at least transiently to a temperature below the critical temperature. This may result in cooling of items within the payload container to too low a temperature. Since overcooling of items in the payload container such as vaccines can cause damage to the items, prevention of overcooling during transport of the apparatus may be particularly important in some applications. It is to be understood that by limiting the flow of thermal fluid to cellular volumes, the risk of overcooling may be reduced.

Optionally, one or more of the cells are disposed such that the cell includes a portion of the head region and a portion of the body region of the fluid reservoir.

Optionally, one or more cells are arranged such that the cell includes a volume spanning a height of the reservoir from substantially the uppermost region of the reservoir to substantially the lowermost region.

Optionally, one or more cells are arranged such that the cell includes a volume spanning substantially a depth of the reservoir from a wall adjacent the cold store portion to the second heat exchange portion.

Optionally, two or more cells are arranged in a stacked configuration, one above the other, with respect to a normal upright orientation of the apparatus.

Optionally the fluid reservoir comprises at least one internal wall arranged to divide the reservoir into a plurality of compartments.

Optionally the at least one internal wall is arranged in use to have a sufficiently low thermal resistance to allow thermal equilibration of fluid on opposite respective sides of the wall.

Optionally the at least one internal wall is arranged to be thermally insulating such that thermal transfer between fluid on opposite respective sides of the wall is substantially prevented.

Optionally the plurality of compartments are provided in fluid isolation from one another.

Alternatively at least two of the plurality of compartments are provided in fluid communication with one another.

Thus fluid may be permitted to flow between compartments in some embodiments.

The presence of the internal walls has the advantage in some embodiments that movement of fluid in the reservoir during handling or transport of the apparatus may be restricted, reducing a risk that overcooling of the second heat exchange portion occurs.

By allowing fluid flow between two or more compartments, filling of the apparatus with fluid during manufacture or commissioning of the apparatus may be facilitated.

Optionally the fluid reservoir contains a thermal fluid having a critical temperature, the critical temperature being a temperature above which the fluid exhibits a positive coefficient of thermal expansion and below which the fluid exhibits a negative coefficient of thermal expansion.

In embodiments having fluid-filled cells, the thermal fluid may be contained within the fluid-filled cells. In addition, at least some of the fluid-filled cells may be immersed in thermal fluid.

The apparatus may comprise cooling means for cooling the cold store portion.

The cooling means may comprise a powered refrigeration unit or element, optionally in addition a power supply unit for providing power to the refrigeration unit.

The apparatus may comprise a sensor, the apparatus being configured to interrupt cooling of the cold store portion by the cooling means in dependence at least in part on a signal generated by the sensor.

The apparatus may be configured to interrupt cooling of the cold store portion by the cooling means when a temperature of the sensor falls below a predetermined temperature.

The sensor may be arranged to monitor a temperature of an interior of the cold store portion. The sensor may be located in an upper (or lower) region of the cold store portion.

In some alternative embodiments the sensor may be arranged to monitor a temperature of fluid in the head region of the fluid reservoir. The sensor may be provided in substantially direct thermal communication with fluid within the head region of the reservoir in some embodiments.

Optionally the sensor may be at least partially immersed in fluid in the head region of the reservoir.

The sensor may be disposed to detect the formation of solidified fluid, optionally ice in the head region of the fluid reservoir in the case the head region contains a fluid comprising water. The sensor for detecting solidified fluid may be a temperature sensor; the apparatus may be arranged to determine that solidified fluid is present when the temperature measured by the sensor falls below a prescribed value, optionally 1-2 Celsius, further optionally below 4 Celsius, still further optionally below 3 Celsius. Other values are also useful.

The sensor may be disposed a sufficient distance from the cold store heat exchange portion to allow a sufficiently large volume of fluid in the head region of the reservoir to be cooled to a sufficiently low temperature before interrupting operation of the refrigeration unit.

Methods of detecting formation of a frozen body other than thermal measurements are also useful. For example, interference of frozen fluid with a mechanical device such as a rotating vane may be a useful means for detection of frozen fluid in some embodiments. Furthermore, a change in volume of the fluid (including frozen fluid) within the fluid reservoir may be a useful measure of the presence of frozen fluid, for example an increase in the volume such that the volume exceeds a prescribed amount may indicate that a sufficiently large volume of frozen fluid has been formed.

In embodiments in which solidification of fluid does not take place in the range of temperatures at which the apparatus operates, the temperature sensor may be arranged to detect when a volume of fluid below a set temperature value has grown sufficiently large substantially to contact the temperature sensor, at which point operation of the cooling means may be interrupted.

It is to be understood that once the temperature detected by the sensor has risen above the set value, operation of the refrigeration unit may be resumed. A suitable time delay may be introduced before operation is resumed in order to prevent repeated switching on and off of the refrigeration unit. Alternatively the temperature at which the refrigeration unit resumes operation may be higher than that below which it terminates operation by an amount sufficient to prevent repeated switching on and off of the refrigeration unit in rapid succession. Thus, hysteresis may be introduced in respect of the temperature at which the refrigeration unit is switched on an off.

In typical embodiments, the refrigeration unit includes an electrically-powered compressor. However, refrigeration units using other refrigeration technology may also be useful. One example of such alternative technology is a Stirling engine cooler. The Stirling engine cooler may be arranged to be operated in a solar direct drive mode.

Optionally, the cold store portion and fluid reservoir are substantially vertically coextensive.

Thus, the cold store portion and reservoir may extend to substantially the same height.

Further optionally, the cold store portion and fluid reservoir are substantially laterally coextensive. Thus, the cold store portion and reservoir may extend to substantially the same width.

Thus in some embodiments a lateral dimension such as a width of the cold store portion transverse to a direction from the cold store to the reservoir (and optionally towards the payload container, in embodiments having a payload container), may be substantially equal to that of the fluid reservoir.

In an aspect of the invention for which protection is sought there is provided a method of cooling comprising:

providing at least one cooling object in a cold store portion of a cooling apparatus, the at least one cooling object being provided in thermal communication with a cold store heat exchange portion;

cooling by means of the cold store heat exchange portion a thermal fluid in a head region of a fluid reservoir that is in thermal communication with the cold store heat exchange portion, the fluid reservoir being arranged in a side by side relationship with the cold store portion, the method comprising cooling thermal fluid in the head region thereby to cause cooling of thermal fluid in a body region below the head region which causes in turn cooling of a second heat exchange portion that is provided in thermal communication with fluid in the body region.

The method may comprise providing the second heat exchange portion and cold store portion on substantially opposite sides of the reservoir.

The method may comprise providing the second heat exchange portion in substantially direct thermal contact with fluid in the fluid reservoir below the head region and not with fluid within the head region.

The method may comprise cooling by means of the second heat exchange portion an interior volume of a payload container.

Optionally, cooling the second heat exchange portion comprises cooling a pipe in which a fluid to be cooled is disposed.

The method may comprise providing a cooling object in the cold store portion in substantially direct thermal contact with the cold store heat exchange portion.

Optionally, cooling a thermal fluid comprises cooling a thermal fluid having a critical temperature, the critical temperature being a temperature above which the fluid exhibits a positive coefficient of thermal expansion and below which the fluid exhibits a negative coefficient of thermal expansion, the method comprising cooling thermal fluid in the head region by means of the heat exchange portion to a temperature at or below the critical temperature.

Optionally, cooling thermal fluid in the head region by means of the cold store heat exchange portion comprises cooling the thermal fluid to a temperature substantially at or below the critical temperature.

The method may comprise cooling thermal fluid in the head region whereby fluid in the body region is maintained at a temperature substantially equal to the critical temperature.

Optionally, the method comprises cooling thermal fluid in the head region whereby the interior volume of the payload container is maintained at a temperature substantially equal to the critical temperature.

In an aspect of the invention for which protection is sought there is provided cooling apparatus comprising:

a cold store portion for storing at least one cooling object;

a fluid reservoir for holding fluid to be cooled, the reservoir having a head region and a body region below the head region each arranged to contain fluid to be cooled; and a cold store heat exchange portion arranged in use to be provided in thermal communication with a cooling object in the cold store portion and a fluid in the head region of the fluid reservoir.

Optionally, the cold store heat exchange portion is arranged in use to be provided in substantially direct thermal contact with a cooling object in the cold store portion.

The cold store heat exchange portion may comprise a portion of a wall of the fluid reservoir.

The cold store heat exchange portion may comprise a cold store heat exchange element configured in use to be provided in substantially direct thermal contact with a cooling object such as a cold pack in the cold store portion.

The cold store heat exchange portion may be provided in substantially direct thermal contact with the wall of the reservoir.

Advantageously the cold store heat exchange element may be arranged to extend to a lower region of the cold store portion such that in use the heat exchange element may be in thermal contact with a cooling object resting on a basal surface of the cold store portion.

The cold store portion may be sized to receive a plurality of cold packs.

Advantageously the apparatus may comprise resilient urging means for maintaining a cooling object in substantially direct thermal contact with the cold store heat exchange portion.

The cold store heat exchange portion may be arranged to be in thermal contact with fluid in the head region and not with fluid below the head region of the fluid reservoir.

Thus the cold store heat exchange portion may be arranged to cool directly fluid in the head region and not fluid below the head region. Fluid below the head region may optionally be cooled indirectly by fluid in the head region by conduction of heat from fluid below the head region, through fluid in the head region, to the cold store heat exchange element, or by movement of fluid in the head region to the region below the head region, displacing fluid below the head region upwardly.

Optionally, a thermal resistance of the apparatus to flow of heat from fluid in the fluid reservoir to the cold store portion is higher for fluid below the head region compared with fluid in the head region.

This may be achieved in some embodiments by providing insulation means between the cold store portion and fluid reservoir over an area of a wall of the fluid reservoir between the cold store portion and body region of the fluid reservoir. The insulation means may comprise an insulating material such as an expanded polystyrene material or a solid foam. Alternatively or in addition the insulation means may comprise a volume of gas, or an evacuated volume. Other arrangements are also useful.

Optionally, the fluid reservoir is provided in thermal contact with a second heat exchange portion arranged to allow flow of thermal energy from a heat source to fluid in the fluid reservoir below the head region. The heat source may be in the form of a payload container or items in a payload container that are to be cooled. The second heat exchange portion may be provided by or provide a portion of a payload container for holding items to be cooled. In some embodiments the heat source may be a fluid to be cooled that is in thermal communication with the second heat exchange portion which may for example be a pipe for carrying fluid such as beverage, or any other fluid to be cooled.

It is to be understood that the apparatus may be configured substantially to prevent flow of thermal energy from the heat source directly to fluid in the head region. That is, a thermal resistance of the apparatus to flow of thermal energy through a barrier separating the heat source from fluid in the head region may be arranged to be relatively high.

The second heat exchange portion may be provided in substantially direct thermal contact with fluid in the fluid reservoir below the head region and not with fluid within the head region.

The second heat exchange portion may include a portion of a wall of the fluid reservoir below the head region.

The second heat exchange portion may be arranged to allow flow of thermal energy from an interior volume of a payload container to fluid in the fluid reservoir below the head region.

Direct cooling of the interior volume of the payload container by fluid in the region of the fluid reservoir below the head region and not fluid in the head region may be achieved in some embodiments by providing thermal insulation means between fluid in the head region and the interior volume of the payload container. The thermal insulation means may comprise an evacuated region. Alternatively or in addition the thermal insulation means may comprise an insulating material. It is to be understood that the insulating material may optionally be provided within the payload container, optionally against a wall of the payload container that is between an internal storage volume of the payload container and fluid in the fluid reservoir. Optionally the insulation means may alternatively or in addition be provided within the fluid reservoir, optionally against an internal surface of a wall thereof, such that the insulation means is disposed between fluid in the head region of the reservoir and the internal storage volume of the payload container.

It is to be understood that because fluid in the head region will typically be at a relatively low temperature compared with fluid in the body region, thermal communication between fluid in the head region and the payload container may be undesirable, since it may result in excessively low temperatures being established in the payload container that could damage material stored therein such as a vaccine.

Optionally the fluid storage reservoir comprises a plurality of fluid cells. Fluid in respective adjacent cells may be separated by at least one cell wall portion, the at least one cell wall portion being arranged to allow transfer of thermal energy between fluid in respective adjacent cells.

One or more of the cells may include a portion of the head region and a portion of the body region of the fluid reservoir.

One or more of the cells include a volume spanning a distance from substantially the uppermost region of the reservoir to substantially the lowermost region.

Alternatively or in addition one or more of the cells may include a volume spanning a width of the reservoir. That is, a lateral dimension of the reservoir.

One or more of the cells may be stacked one above the other with respect to a normal upright orientation of the apparatus.

Advantageously the fluid reservoir may be substantially filled with thermal fluid having a critical temperature, the critical temperature being a temperature above which the fluid exhibits a positive coefficient of thermal expansion and below which the fluid exhibits a negative coefficient of thermal expansion.

That is, as a temperature of the fluid rises to become substantially equal to the critical temperature a density of the fluid increases, whilst as the temperature of the fluid rises from the critical temperature, the density of the fluid decreases.

The fluid may comprise water. The fluid may consist substantially of water. Alternatively the fluid may comprise water with an additive such as a salt, optionally sodium chloride. Thus the fluid may be or comprise a brine in some embodiments. The additive may be or include a solvent such as an alcohol. Other solvents and other additives are also useful. In some embodiments the fluid may be or comprise an oil, or a mixture of oil and one or more other liquids or solids. Other liquids are also useful.

The apparatus may comprise cooling means for cooling the cold store portion.

Optionally the cooling means comprises a refrigeration unit or element, optionally in addition a power supply unit for providing power to the refrigeration unit.

The power supply unit may comprise a solar electric generator unit arranged to generate electricity from solar energy. Alternatively the refrigeration unit may be fuel fired, optionally gas fired.

The apparatus may comprise a sensor, the apparatus being operable to interrupt cooling of the cold store portion by the cooling means when a temperature of the sensor falls below a prescribed temperature.

The cold store portion and fluid reservoir may be provided in a side by side configuration.

Optionally the cold store portion and fluid reservoir are substantially vertically coextensive.

In addition or instead the cold store portion and fluid reservoir may be substantially laterally coextensive.

It is to be understood that in some embodiments, and each of the embodiments described herein, the cold store portion is not immersed in the reservoir. Indeed in the embodiments described herein the payload container is also not immersed in the reservoir. However it is to be understood that in some embodiments at least a portion of the cold store portion may be immersed in the reservoir, for example the head region of the reservoir, in thermal communication therewith. Similarly, in some embodiments at least a portion of the payload container may be immersed in the reservoir, for example the body region of the reservoir, in thermal communication therewith.

According to another aspect of the present invention for which protection is sought, there is provided a refrigeration apparatus comprising an apparatus according to the previous aspect and a payload volume for containing an object or item to be cooled disposed in thermal communication with fluid in the fluid reservoir.

In an embodiment, the payload volume may comprise one or more shelves for supporting items or objects to be cooled. The payload volume may be open fronted. Alternatively, the payload volume may comprise a closure such as a door for thermal insulation thereof. The door may be arranged to allow access into the payload volume from above the volume. Alternatively or in addition the door may allow access into the payload volume from a front or side of the payload volume.

Alternatively or in addition, the payload volume may comprise at least one receptacle within which an article such as a container such as a beverage container, a fruit or any other suitable article can be placed for temperature-controlled storage.

The or each receptacle may comprise a tube or pouch having an opening defined by an aperture disposed in a wall of the fluid reservoir and extending inwardly into the cooling region so as to be submerged therein.

The or each tube or pouch may be closed at its end distal from the opening.

The or each receptacle may be formed from a flexible material, optionally a resilient flexible material such as an elastomeric material.

The or each receptacle may taper from its end proximal to the opening towards its end distal to the opening. Alternatively each receptacle may be untapered, with substantially parallel walls, for example a cylindrical tube of substantially constant diameter along at least a portion of a length thereof, optionally substantially the entire length thereof.

The apparatus may comprise at least two receptacles, the end of each receptacle distal to its respective opening being connected.

The or each receptacle may be arranged to permit transfer of heat from an article held therein to fluid contained in the cooling region.

The apparatus may comprise one or more fluid pipelines through which a fluid to be cooled flows, in use. The pipeline may be arranged to flow through the fluid reservoir. Alternatively or in addition the pipeline may be arranged to flow through the cold store portion. The pipeline may be a pipeline for a beverage dispensing apparatus. The apparatus may be configured whereby beverage to be dispensed is passed through the pipeline, optionally by means of a pump and/or under gravity.

In an embodiment, the payload volume may be arranged to contain one or more articles such as one or more batteries. The batteries may be arranged to be cooled by the apparatus whilst the batteries are being charged and/or whilst the batteries are discharging current. The apparatus may form part of a telecommunications installation and arranged to power one or more items of telecommunications equipment such as a transmitter, a receiver, a transceiver or the like.

The apparatus may comprise an article heat exchanger portion arranged to be fed with fluid from the fluid reservoir. Fluid from the fluid reservoir may be arranged to circulate through the article heat exchanger portion and the fluid reservoir.

The apparatus may comprise means for passing air over or through the article heat exchanger portion towards, onto or around the article.

The means for passing air may comprise a fan or compressor in fluid communication with the article heat exchanger portion via a ducting.

The article heat exchanger portion may be disposed within a housing in fluid communication with the ducting, the housing comprising one or more apertures therein through which air passing over or through the article heat exchanger portion is expelled from the housing towards, onto or around the article.

The housing may comprise a plurality of apertures, optionally apertures of relatively small diameter compared with a surface area of the article to be cooled.

The article heat exchanger portion may comprise a container having a plurality of heat exchange surfaces.

The heat exchange surfaces may comprise a plurality of exchange conduits or apertures arranged to permit air to pass through the article heat exchanger portion in thermal communication with fluid in the article heat exchanger portion.

The article heat exchanger portion may be formed from a thermally transmissive material, i.e. a material of relatively low thermal resistance.

The apparatus may alternatively comprise an article heat exchanger portion provided in direct thermal communication with fluid that is in the fluid reservoir, the apparatus being arranged to pass coolant gas through the article heat exchanger portion to allow heat exchange between the coolant gas and fluid that is in the fluid reservoir, subsequently to direct the coolant gas towards, onto or around the article.

The article heat exchanger portion may comprise one or more conduits in thermal communication with fluid in the fluid reservoir. The one or more conduits may be immersed in fluid in the fluid reservoir. The article heat exchanger portion may comprise a plurality of conduits, optionally an array of spaced apart conduits, optionally substantially parallel to one another, within the fluid reservoir.

The apparatus may comprise a fan or compressor in fluid communication with the article heat exchanger portion via a duct, the fan or compressor being arranged to pump coolant gas through the article heat exchanger portion.

In an embodiment cooling of fluid in the cold store portion may be performed at least in part by means of a flow of a subject fluid through a heat exchanger to cool the first fluid.

Optionally, the subject fluid may for be a fluid that has been and/or is to be used in a process. For example, the subject liquid may be a refrigerant that has been used in a cooling process, for example to cool a heat exchanger of a freezer. Refrigerant exiting the heat exchanger of the freezer may be at a temperature of (say) −5° C. or any other suitable temperature below the critical temperature of fluid in the fluid reservoir. The refrigerant may be arranged to pass through a heat exchanger such as a tube immersed in the fluid in the first fluid reservoir, to cool the fluid. The refrigerant may then be returned to a compressor where it may be compressed and cooled in a further heat exchanger before being caused to expand to effect cooling.

In an embodiment, a further heat exchange fluid may be employed to draw heat from the cold store portion, the heat exchange fluid being subsequently cooled by a further fluid. The further fluid may be a refrigerant that has exited a heat exchanger of another refrigeration apparatus such as a conventional freezer or other refrigeration apparatus.

In some embodiments, a source of fluid for cooling fluid in the cold store portion of head region of the reservoir may be provided by water from a lake, river or sea that is at a temperature below the critical temperature. For example, a source of water at a temperature close to or below 0° C. may be employed.

Other arrangements are also useful.

In an embodiment, the apparatus is configured to be disposed within a conventional refrigerator or the like. In this embodiment, the cooling means may comprise the existing cooling element of the refrigerator. The apparatus may be arranged to be positioned within the refrigerator such that the head region of the fluid reservoir is in thermal communication with the existing cooling element so as to cool the fluid therein.

The apparatus may for example be in the form of a structure formed to fit within a conventional refrigerator. The apparatus may be moulded or otherwise formed to fit within a conventional refrigerator.

In one aspect of the invention for which protection is sought there is provided an apparatus for cooling objects such as food items, beverages or vaccines comprising a cold store portion and a fluid reservoir, the cold store portion and fluid reservoir being provide in fluid communication with one another.

Other arrangements are also useful.

In an aspect of the invention for which protection is sought there is provided a method of cooling comprising:

providing at least one cooling object in a cold store portion of a cooling apparatus, whereby the at least one cooling object is in thermal communication with a cold store heat exchange portion;

cooling a thermal fluid in a head region of a fluid reservoir that is in thermal communication with the cold store heat exchange portion, the fluid reservoir having a body region below the head region, whereby cooling of thermal fluid in the head region causes cooling of thermal fluid in the body region.

Cooling the thermal fluid may comprise cooling a thermal fluid having a critical temperature, the critical temperature being a temperature above which the fluid exhibits a positive coefficient of thermal expansion and below which the fluid exhibits a negative coefficient of thermal expansion, the method comprising cooling thermal fluid in the head region by means of the heat exchange portion to a temperature at or below the critical temperature.

In one aspect of the invention for which protection is sought there is provided cooling apparatus comprising:

a pack storage portion for storing at least one coldpack;

a fluid reservoir for holding fluid to be cooled, the reservoir having a head region; and a cold pack heat exchange portion arranged in use to be provided in thermal contact with a cold pack in the pack storage portion and a fluid in the head region of the fluid reservoir.

According to another aspect of the invention for which protection is sought, there is provided apparatus comprising:

a pack storage portion for storing at least one coldpack;

a liquid reservoir for holding liquid to be cooled, the reservoir having a head region; and a cold pack heat exchange portion arranged in use to be provided in thermal contact with a cold pack in the pack storage portion and a liquid in the head region of the fluid reservoir.

It is to be understood that by critical temperature is meant a temperature at which a maxima in fluid density as a function of temperature is observed. Thus, the density of the fluid increases as its temperature rises towards the critical temperature and then decreases as the temperature rises above the critical temperature, meaning that its density is at its maximum at the critical temperature.

It is to be understood that the pack storage portion is arranged, in use, to cool fluid in the head region of the fluid reservoir.

In one aspect of the invention for which protection is sought there is provided cooling apparatus comprising:

a fluid reservoir for holding fluid to be cooled, the reservoir having a head region and a body region below the head region each arranged to contain fluid to be cooled; and cooling means in thermal communication with fluid in the head region and not fluid in the body region, the cooling means being configured in use to permit cooling of fluid in the head region and not fluid below the head region.

Thus the cooling means does not provide direct cooling of fluid below the head region. Thus the cooling means is not in substantially direct thermal communication with fluid below the head region. Cooling of fluid below the head region may take place by thermal conduction through fluid in the head region of the reservoir, and/or by sinking of cooled fluid in the head region to the region below the head region.

The cooling means may comprise a cold store portion. The cold store portion may be arranged to allow storage of at least one cooling object. A cold store heat exchange portion may be arranged in use to be provided in thermal communication with a cooling object in the cold store portion and a fluid in the head region of the fluid reservoir and not fluid below the head region.

The cooling means may in addition or instead comprise powered cooling means. The powered cooling means may be provided in the form of an electrically powered cooling element configured to cool fluid in the head region and not fluid in the body region.

The cooling element may be powered by means of an external power supply (not shown) such as a mains electricity power supply, one or more photovoltaic panels or any other suitable source of power.

Optionally, the fluid reservoir is provided in thermal contact with a second heat exchange portion arranged to allow flow of thermal energy from a heat source to fluid in the fluid reservoir below the head region.

Optionally, the second heat exchange portion is provided in substantially direct thermal contact with fluid in the fluid reservoir below the head region and not with fluid within the head region.

Optionally, the second heat exchange portion is arranged to allow flow of thermal energy from an interior volume of a payload container to fluid in the fluid reservoir below the head region.

Thus the apparatus may comprise a payload container arranged to contain items for temperature controlled storage.

The second heat exchange portion may be configured to allow flow of thermal energy from a fluid in contact therewith to fluid in the fluid reservoir below the head region.

The second heat exchange portion may comprise a conduit through which fluid to be cooled may be passed. The conduit may be in the form of a pipe, optionally a coiled pipe. The apparatus may be configured for connection to a source of fluid to be cooled and a fluid dispense apparatus. Optionally the apparatus is configured for connection to a source of beverage such as a tank or other container of beverage. The apparatus may be configured for connection to a beverage dispense apparatus.

In one aspect of the invention there is provided an assembly comprising apparatus according to any preceding aspect in combination with liquid dispense apparatus, optionally beverage dispense apparatus. The assembly may further comprise a source of beverage to be dispensed.

DETAILED DESCRIPTION OF EMBODIMENTS

Embodiments of the present invention will now be described, by way of example only, with reference to the accompanying drawings, in which.

Figure 2:
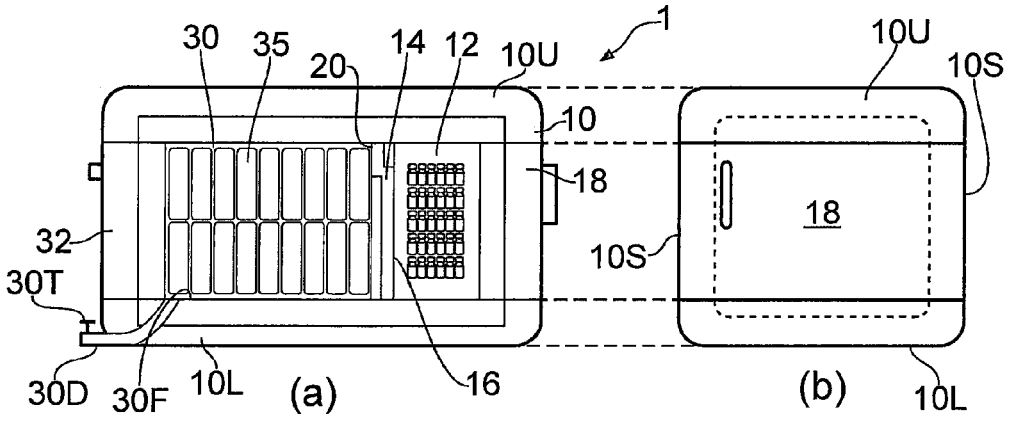
FIG. 2 shows (a) a section through an apparatus embodying one form of the invention and (b) a front view of the apparatus.
Figure 6:
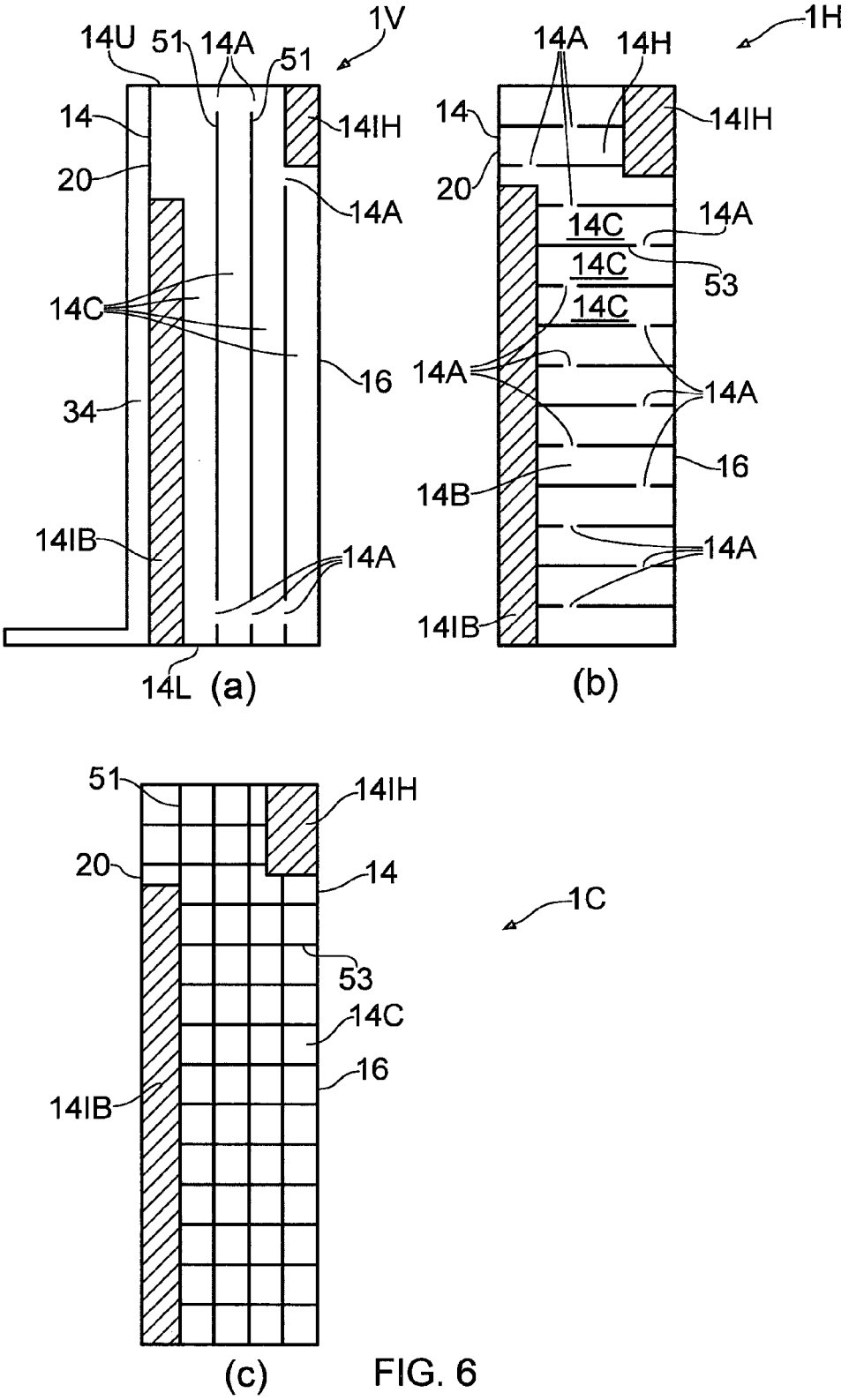
Figure 7:
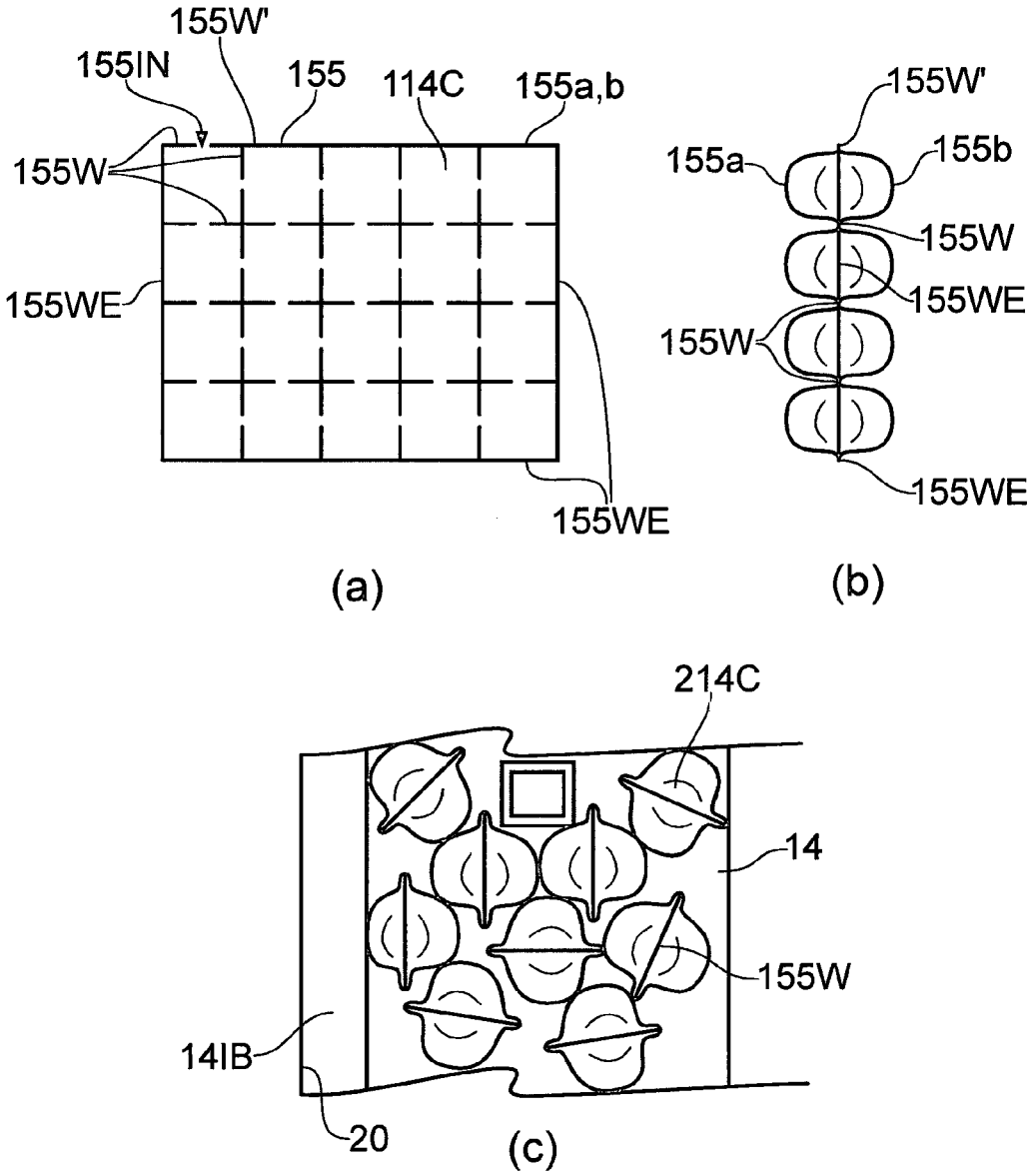

FIG. 6 is a section fluid reservoirs according to further embodiments of the invention in which the fluid reservoirs are divided into cells by baffle elements disposed (a) in a substantially vertical orientation, (b) in a substantially horizontal orientation and (c) in horizontal and vertical orientations so as to define a stacked cellular structure; and FIG. 7 shows (a) a front view and (b) a side view of a sheet of plastics materials following stage 1 of a process of fabricating an array of fluid filled cellular cavities and (b) a side view of the sheet following stage 2 of the process, and (c) the fluid filled cellular cavities shown in (b) following re-welding and cutting to form loose sealed cellular cavities provided in a fluid reservoir of an apparatus according to an embodiment of the invention such as the embodiment of FIG. 2.

Within the following description, as far as possible, like reference numerals indicate like parts.

Figure 1:
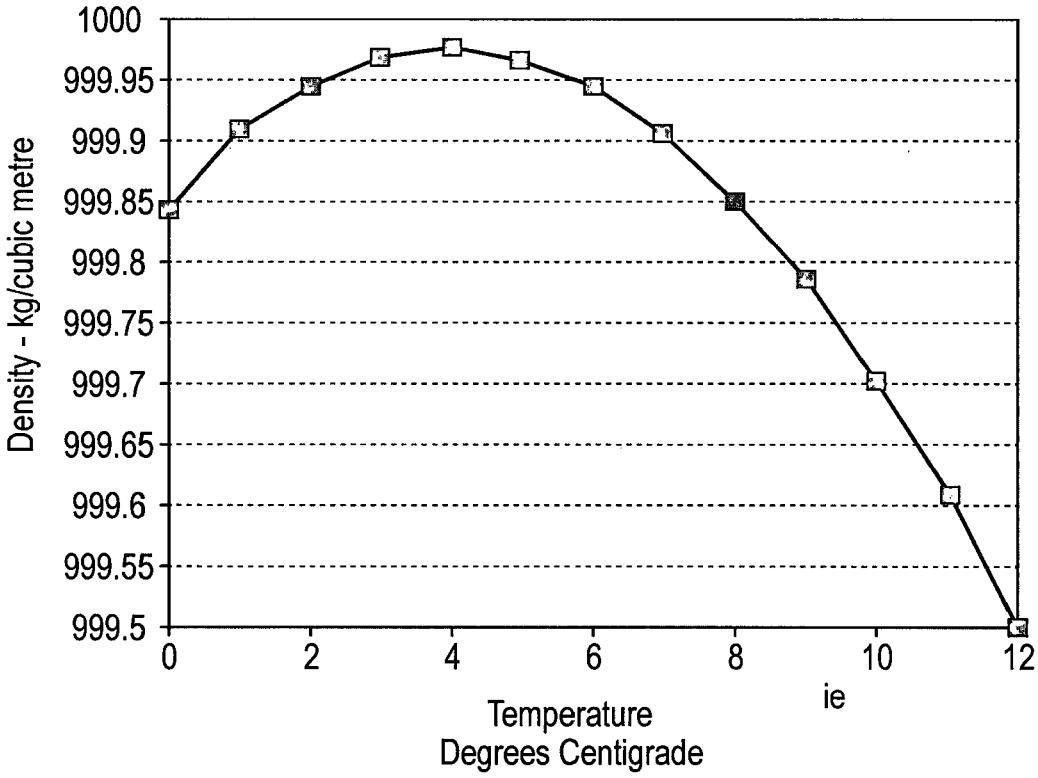
FIG. 1 is a graph of the density of water against temperature.

It will be understood from the foregoing that embodiments of the present invention rely upon one of the well-known anomalous properties of certain fluids such as water: namely, that its density is maximum at a critical temperature in respect of temperature coefficient of thermal expansion (in the case of water, approximately 4° C.), as shown in FIG. 1. Reference to water as an example will be used herein, but it is to be understood that other fluids having a similar property in respect of temperature coefficient of thermal expansion are also useful. Fluids comprising water and one or more additions are also useful, such as water and a salt. The salt may allow the critical temperature to be lowered. Other additives are useful for lowering or raising the critical temperature of water, or other fluids. Other fluids such as oils having a critical temperature may also be useful.

The fact that water has a maximum in density as a function of temperature at the critical temperature is a consequence of the fact that water has a negative temperature coefficient of thermal expansion below approximately 4° C. and a positive temperature coefficient of thermal expansion above approximately 4° C. Hereinafter, the term "critical temperature" will be used to refer to the temperature at which the density of the fluid is at its maximum, being approximately 4° C. in the case of water, and above and below which the density decreases. In some embodiments a fluid may have a plurality of critical temperatures such that reference to the 'maximum density' may be reference a local maximum density.

In the apparatus disclosed in co-pending PCT application no. PCT/GB2010/051129, a headspace containing a frozen fluid is disposed above a payload space that is immersed in liquid fluid. This arrangement is functionally advantageous but may be compromised in terms of packaging for certain applications. More particularly, the applicants have identified that the disposition of the headspace above the payload space may limit the retail frontage available for use in some arrangements. That is to say, the head space occupies a portion of the apparatus volume at the front of the apparatus which may be the most valuable or useful refrigerated storage space.

Referring firstly to FIG. 2, a refrigeration apparatus embodying a first form of the invention is shown generally at 1.

The apparatus 1 comprises a casing 10, which is, in this embodiment, shaped generally as an upright cuboid. In the non-limiting embodiment shown the casing is of length 100 cm, width 400 cm and height 500 cm. Other dimensions are also useful. It is to be understood that by length is meant a dimension of the casing from left to right in the cross-sectional schematic illustration of FIG. 2(*a*). By width is meant a dimension of the casing from left to right in the front view of FIG. 2(*b*). By height is meant a dimension of the casing from top to bottom in the views of FIG. 2(*a*) or (*b*).

The casing 10 is formed from a thermally insulative material to reduce heat transfer into or out of the apparatus 1. For example, the casing 10 may be formed as a one-piece rotational moulding of a plastics material. The volume within the casing 10 is divided into three adjacent compartments, a payload compartment 12, a fluid reservoir 14 and a cold pack storage volume 30. The payload compartment 12 and fluid reservoir 14 are separated by means of a separator in the form of a thermally conductive wall 16 extending between internal upper wall 10U, lower wall 10L and side walls 10S of the casing 10. The fluid reservoir 14 and cold pack storage volume 30 are separated by means of a further thermally conductive wall 20 also extending between the upper wall 10S, lower wall 10L and side walls 10S of the casing 10.

The payload compartment 12 is arranged to store one or more objects or items to be cooled, such as vaccines, food items or packaged drinks.

The payload compartment 12 has a closure in the form of a payload door 18 provided at a front face thereof which can be opened to gain access to the compartment 12. Access is gained in a substantially horizontal direction in the embodiment shown, as used in a normal upright orientation. Insulating material is carried on the door 18 so that, when it is closed, heat transfer therethrough is reduced. In an alternative embodiment (not shown) the payload compartment 12 may be open-faced, permitting easy access to objects or items stored therein. For example, the payload compartment may comprise a shelving unit for use in retail outlets or shops.

In a still further embodiment, access into the payload compartment may be from above the apparatus in the normal upright orientation, i.e. in a substantially vertical direction. Other arrangements are also useful.

Figure 3:
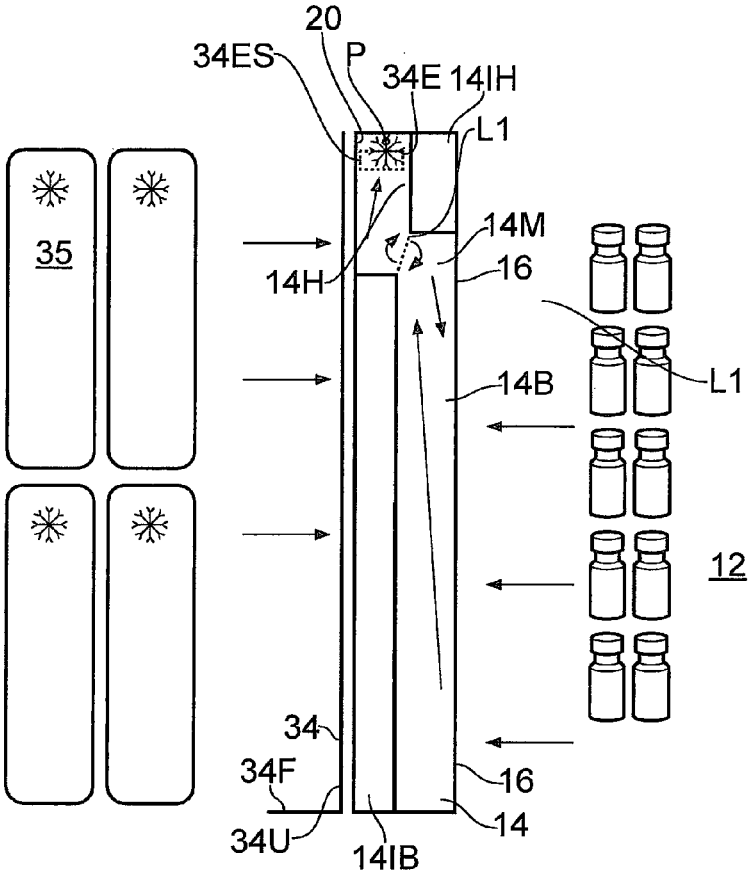
FIG. 3 is an enlarged view of a portion of the apparatus as shown in FIG. 2(*a*)

FIG. 3 shows in more detail a working portion of the apparatus 1. The fluid volume 14 has a head region 14H in an upper portion thereof and a body region 14B below the head region 14H. A boundary between the head region 14H and body region 14B is indicated by dashed line L1. A first sheet of thermally insulating material 141H is provided in abutment with the portion of the wall 16 separating the head region 14H of the fluid reservoir 14 from the payload compartment 12. The insulating material 141H is arranged substantially to reduce an amount of cooling of the payload compartment 12 by fluid in the head region 14H. This is because, as explained in more detail below, fluid in the head region 12 may be at a temperature below the critical temperature of coolant in reservoir 14. The insulating material 141H does not extend to the portion of the wall 16 separating the body region of the fluid reservoir 14B from the payload compartment 12. This portion of the wall 16 is arranged to allow flow of thermal energy from the inner volume of the payload compartment 12 to fluid in the body region of the fluid reservoir 14B in order to cool the inner volume of the payload compartment 12. In the present embodiment the insulating material 141H is formed from a foamed polystyrene material. Other insulating materials are also useful.

A second sheet of thermally insulating material 141B also formed from a foamed polystyrene is provided in abutment with the portion of the wall 20 separating the body region of the fluid reservoir 14B from the pack storage volume 30. This sheet 141B is arranged to prevent direct cooling of fluid in the body region 14B of the fluid reservoir 14 by flow of thermal energy from the body region 14B into the pack storage volume 30 through the wall 20.

The pack storage volume 30 is arranged for storage of two layers of cold packs 35 one above the other. Cold packs 35 are introduced into the pack storage volume 30 through a pack access door 32 at an opposite end of the apparatus 1 to the payload door 18. The packs 35 closest to the fluid reservoir 14 are arranged to contact a heat exchange plate 34 that is attached to and is substantially coextensive with the wall 20 separating the pack storage volume 30 from the fluid reservoir 14. The packs 35 cause cooling of the heat exchange plate 34 and in turn fluid in the head region 14H of the fluid reservoir 14.

In the embodiment shown the conductor plate is substantially 'L'-shaped, having an upright portion 34U that is attached to and coextensive with wall 20 and a foot portion 34F defining a lower portion thereof that extends substantially at right angles away from the upright portion 34U. The foot portion 34F rests on a floor 30F of the pack storage volume 30 such that one or more packs 35 that are in abutment with the upright portion 34U rest on the foot portion 34L. This feature enhances cooling of the heat exchange plate 34 and therefore transfer of thermal energy from the reservoir 14 to the cold packs 35.

It is to be understood that other means for cooling the heat exchange plate 34 may be introduced into the pack storage volume 30 in addition to or instead of cold packs, such as blocks of dry ice (solid carbon dioxide), blocks or particles of ice (solid water) or any other suitable cooling means. The cooling means may cause cooling of the heat exchange plate 34 by conduction and/or convection, by cooling of air (or other gas) in the ambient environment of the storage volume 30. Alternatively or in addition the cooling means may cause cooling of the heat exchange plate 34 by direct contact therewith. In the case of the use of ice as the cooling means, it is to be understood that because the conductor plate 34 spans the height of the storage volume 30, as the ice melts and forms liquid water in the lowest regions of the storage volume 30, the water may assist in conducting heat from the heat exchange plate 34 to any remaining ice. In some embodiments, the access door 32 to the storage volume 30 may be substantially fluid tight when closed.

In some embodiments the heat exchange plate 34 may extend along an interior surface of one or both side walls 10S of the pack storage volume 30 to promote transfer of heat to cold packs or other cooling means in the pack storage volume 30.

In some embodiments the heat exchange plate 34 may extend into the head region 14H of the fluid reservoir 14. Alternatively, in some embodiments a further conductor of heat such as a further metallic plate or other element or the like may be provided within the head region 14H that is in thermal communication with the heat exchange plate 34.

In order to illustrate an example of this latter feature, an extender element 34E is shown in dashed outline in the head region 14H of the embodiment of FIG. 3. The extender element 34E is in the form of a substantially planar metallic plate bent into a substantially L-shaped configuration similar to that of the heat exchange plate 34, a foot portion of the plate 34 being provided in contact with the wall 20. The extender element 34E is in thermal communication with the heat exchange plate 34 by means of a support element 34ES. In the embodiment shown the support element 34ES is in the form of a bolt-type fixing element that passes through the heat exchange plate 34, wall 20 and planar foot portion of the extender element 34E thereby to support the element 34E and maintain it in thermal communication with the heat exchange plate 34.

Other arrangements may be useful in some embodiments.

In some embodiments the heat exchange plate 34 may have one or more further conductors coupled thereto or provided integrally therewith that extend into the storage volume 30 to enhance conduction of heat from the head region 14H of the reservoir 14 to cold objects within the storage volume 30 such as cold packs or loose frozen coolant such as ice.

In some embodiments the pack storage volume 30 may be referred to as a cold store or cooling compartment. In some embodiments access to the cold store 30 may be via a lid or like feature provided in upper wall 10U of the cold store 30 rather than a rear wall as in the embodiment of FIG. 2. The cooling compartment may be provided with a drain pipe 30D for allowing drainage of liquid that may accumulate in the pack storage volume 30 such as water. In the embodiment of FIG. 2 the drain pipe 30D has a tap member 30T operable to allow flow of liquid out through the drain pipe 30D when required. Thus in the case of the use of ice as the cooling means, melted ice may be conveniently drained as required.

It is to be understood that in the case of the use of cold packs 35 containing a liquid such as a water-based liquid such as substantially pure water or a brine, and which are introduced to the pack storage volume 30 in frozen form, melting of the liquid can cause a change in volume of the packs 35, typically shrinkage of the packs 35. Thermal contact between the packs 35 and between the packs 35 and conductor plate 34 can be compromised by this shrinkage, reducing an efficiency of cooling of the plate 34.

Figure 4:
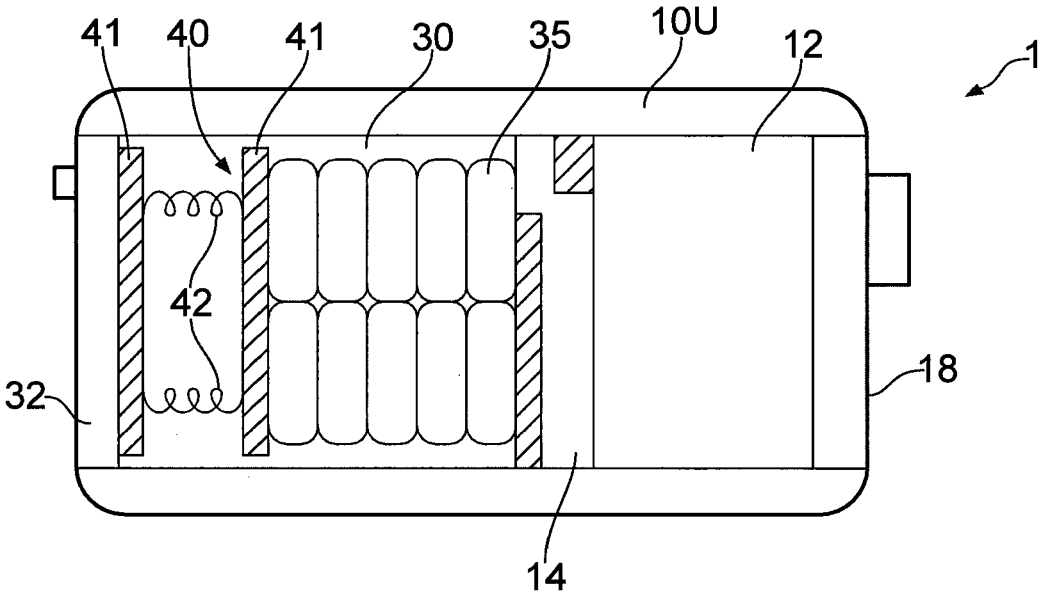
FIG. 4 is a section through an apparatus according to a further embodiment of the invention.

Accordingly, the present applicant has devised means for improving efficiency of cooling the conductor plate 34, in the form of a pack compression module. FIG. 4 shows the apparatus of FIG. 2 with a pack compression module 40 fitted within the pack storage volume 30. The module is arranged to apply pressure to the packs 35 in the storage volume 30, urging the packs 35 in the direction of the conductor plate 34. In the embodiment of FIG. 4, the pack compression module 40 comprises a pair of compression plates 41 arranged in a substantially parallel, side by side configuration, with compression spring elements 40 disposed between the compression plates 41. The compression spring elements 40 are arranged to urge the compression plates 41 apart if the plates 41 are moved towards one another. Accordingly, if the module 40 is placed in the pack storage volume 30 between the door 32 and cold packs 35, such that the spring elements 42 are at least partially compressed, a change in volume of the cold packs 35 will cause a change in the amount by which spring elements 40 are compressed. If the cold packs 35 contract due to melting of liquid or gel therein, the compression plates 41 move apart by a corresponding amount, causing the packs 35 to remain in thermal contact with one another and with the conductor plate 34. Conversely, if the packs 35 expand, the compression plates 41 move towards one another by a corresponding amount, again causing the packs 35 to remain in thermal contact with one another and with conductor plate 34.

It is to be understood that powered cooling means may optionally be provided, for example in the form of an electrically powered cooling element arranged to cool an interior of the pack storage volume 30. The cooling element may be powered by means of an external power supply (not shown) such as a mains electricity power supply, one or more photovoltaic panels or any other suitable source of power.

In some embodiments a cooling element may be arranged to cool the interior of the pack storage volume 30 by means of a refrigerant pumped therethrough. In some embodiments the cooling element 28 may be cooled by refrigerant that has been cooled by expansion of compressed refrigerant in the manner of a conventional vapour-compression refrigeration cycle.

The fluid reservoir 14 contains a volume of a fluid having a negative temperature coefficient of thermal expansion below a critical temperature and a positive temperature coefficient of thermal expansion above the critical temperature. In the illustrated embodiments, the fluid is water, the critical temperature for which is approximately 4° C. The water largely fills the fluid reservoir 14 but a small volume may be left unfilled in an upper portion of head region 14H to allow for expansion. As noted above, liquids other than water are also useful. In particular, liquids are useful that have a critical temperature below which the density of the liquid decreases as a function of decreasing temperature (i.e. having a negative temperature coefficient of thermal expansion when cooled below the critical temperature) and above which the density of the liquid decreases as a function of increasing temperature (i.e. having a positive coefficient of thermal expansion when heated above the critical temperature).

Operation of the apparatus 1 will now be described.

It can be assumed that all of the water in the fluid reservoir 14 is initially at or around the ambient temperature, which may in some environments be in the range from 15 Celsius to 45 Celsius or more. The apparatus 1 is activated by placing cold packs 35 in the pack storage volume 30 such that the cold packs 35 closest to the fluid reservoir 14 are in thermal contact with the conductor plate 34 (FIG. 3). In the present embodiment the cold packs 35 are water-tight plastic containers containing water having a dye therein which does not change substantially the critical temperature or melting point of the water.

In embodiments having an electrical cooling element, if the water in the cold packs has melted, the cooling element is activated to cool the pack storage volume to a temperature that is typically below the freezing point of water, for example, as low as −30° C. This, in turn, causes the water in the cold packs 35 to freeze.

The presence of frozen cold packs in the pack storage volume 30 causes the conductor plate 34 to cool, which in turn causes cooling of water in the head region 14H of the fluid reservoir 14 (FIG. 3). As the water cools, its density increases. The cooled water thus sinks towards the bottom of the body region of the fluid reservoir 14B displacing warmer water which rises towards the head region 14H.

The following discussion of the manner in which embodiments of the present invention accomplish cooling is given by way of example of one model to explain observations made by the present applicant. The discussion is by no means intended to be limiting, and it is possible that cooling of items in the payload container 12 may occur by a mechanism of thermal transfer and/or fluid movement other than that described herein.

In some arrangements, sinking cooled water and rising warmer water may mix in a fluid mixing region 14M at a boundary between the head region 14H and body region 14B of the fluid reservoir 14.

The rising warmer water may for example be at a temperature of approximately 10° C. A transfer of heat from the warmer water to the colder water may thus occur within the mixing region 14M, causing the colder water from the head region 14H and the warmer water from the body region 14B to increase and decrease in temperature, respectively, towards the critical temperature. The fluid mixing region 14M may thus define a thermal transfer region of the apparatus 1 wherein transfer of heat between fluid from the head and body regions may occur. It is to be understood that in some arrangements, water from the head region 14H may sink into the body region 14B and cause cooling of the payload compartment 12.

It is to be understood that if the cold packs 35 are sufficiently cold, ice may form in the head region 14H due to freezing of water in the reservoir 14.

It will be appreciated that, over time, most or all of the water contained in the body region of the fluid reservoir 14 may be cooled to a temperature of 4° C. or less. Because the density of water is at its maximum at the critical temperature, water at this temperature tends to pool at the bottom of the body region 14B of the fluid reservoir 14, displacing lower temperature water towards the head region 14H. This leads to a generally positive temperature gradient being generated within the fluid reservoir 14 with water at the critical temperature lying in the body region 14B and less dense, more buoyant water at temperatures below the critical temperature lying in the head region 14H.

In some embodiments, water in the fluid reservoir 14 cooled following mixing within the mixing region 14M may pool in the body region 14B of the fluid reservoir 14 which, as described above, is disposed in thermal communication with the payload compartment 12. Heat from the payload compartment 12 is thus absorbed by water in the body region 14B. The temperature of the payload compartment 12, and hence objects or items stored therein, decreases.

To reiterate, at least initially, water within the head region 14H of the fluid reservoir 14 may be cooled to temperatures at or below the critical temperature by transfer of thermal energy to the conductor plate 34 in the pack storage volume 30. Water of increased density, for example water at a temperature substantially equal to the critical temperature sinks and may mix in the mixing region 14M with water above the critical temperature. The average temperature of the water in the mixing region 14M may approach the critical temperature as cooling continues, and thus water in the mixing region 14M may sink into the body region, displacing water above the critical temperature upwardly.

Over time, this process may approach a steady state situation through the dynamic transfer of heat between water in the mixing region 14M at the critical temperature and water at temperatures above the critical temperature in the body region 14B. In some embodiments, in the steady state water in the head, mixing and body regions 14H, 14M, 14B may become substantially static, thermal transport taking place primarily via conduction.

Through absorption of heat from the payload compartment 12 by the water in the fluid reservoir 20, the payload compartment 12 is maintained at a desired temperature of approximately 4° C. which is ideal for storing many products including vaccines, food items and beverages.

It is to be understood that in some embodiments the temperature of fluid in the body region 14B under steady state conditions may be adjusted by adjusting a cross sectional area of a flowpath for fluid from the body region 14B through the mixing region 14M to the head region 14H. It is to be understood that by reducing this cross-sectional area, in some embodiments flow of fluid may be inhibited, causing the temperature of liquid in the body region 14B to be increased.

As noted above, in some embodiments the payload container may contain a powered cooling element for cooling the pack storage volume. In some embodiments an ice detector may be provided in the head region 14H of the fluid reservoir 14 for detecting the formation of frozen fluid (in the present example, ice) once frozen fluid has formed and grown to a critical size. Once the detector detects the formation of frozen fluid of the critical size or greater the apparatus may be arranged to switch off the cooling element to prevent excessive freezing of fluid in the reservoir 14. Once the mass of frozen fluid has subsequently shrunk to a size below the critical size, the cooling element may be reactivated.

The detector may be in the form of a thermal probe P in thermal contact with fluid a given distance from wall 20 in the head region 14H. Fluid in thermal contact with the probe P will fall to a temperature at or close to that of the frozen fluid once the frozen fluid comes into contact with the detector P. It is to be understood that a relatively abrupt temperature change typically takes place between the mass of frozen ice and fluid in contact with the ice within a very short distance from the frozen mass. A suitable position for probe P is shown by way of example superimposed on the apparatus 1 of FIG. 3 but not part of that embodiment, since that embodiment does not have a powered cooling means.

In the event that the power supply to the cooling element is interrupted or disconnected, due for example to a power failure, the displacement process described above in respect of water within the head, mixing and body regions 14H, 14M, 14B of the fluid reservoir 14 or transfer of thermal energy by conduction under substantially static fluid conditions may continue whilst frozen fluid remains in cold packs 35 within the pack storage volume 30. Once the frozen fluid is exhausted, in the case that displacement of fluid is occurring the displacement process may begin to slow but may be maintained for a period of time by the continued absorption of heat from the payload space 12 by the water in the body region of the fluid reservoir 14B. Due to the high specific heat capacity of water and the significant volume of water at temperatures below the critical temperature within the fluid reservoir, the temperature in the body region 14B of the fluid reservoir 14 may remain at or close to 4° C. for a considerable length of time.

That is to say, even without a supply of electrical power to the cooling element, the natural tendency of water at the critical temperature to sink and displace water above or below the critical temperature results in the body region 14B of the fluid reservoir 14 holding water at or around the critical temperature for some time after loss of power and melting of the cold packs 35 in the pack storage volume 30, enabling the payload compartment 12 to be maintained within an acceptable temperature range for extended periods of time. Embodiments of the present invention are capable of maintaining fluid in the body region 14B at a target temperature for a period of up to several weeks with a fresh charge of frozen cold packs.

Figure 5:
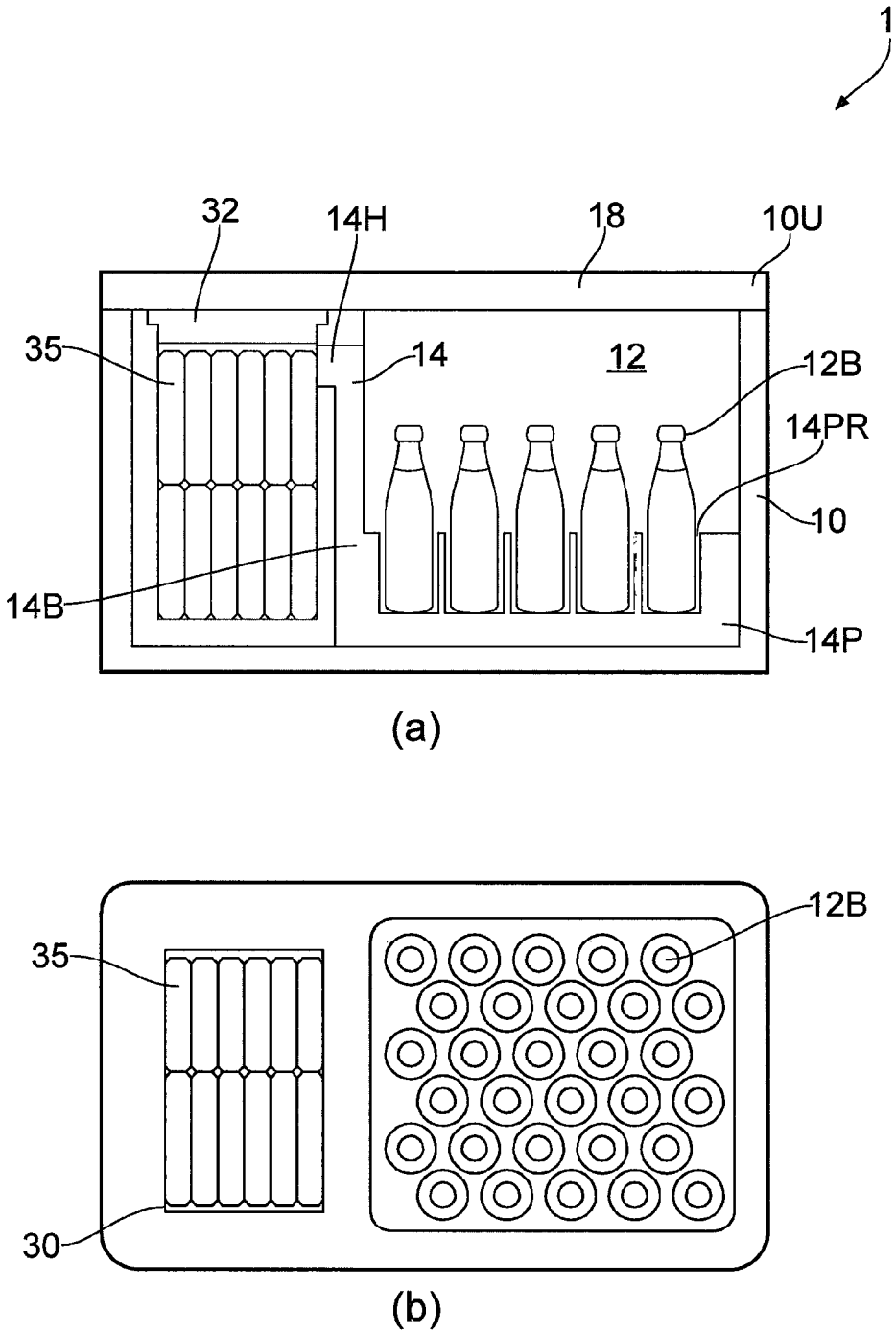
FIG. 5 is (a) a section through an apparatus according to a further embodiment and (b) a corresponding plan view; embodying another form of the invention.

FIG. 5 illustrates apparatus 1T according to a further embodiment of the invention. The apparatus 1T may be considered to be a top-loading version of the apparatus 1 of FIG. 2, which may be referred to as a side-loading version. The apparatus 1 of FIG. 2 is loaded with cold packs by rear door 32 whilst items for storage in payload compartment 12 are loaded via front door 18. In contrast, in the apparatus 1T of FIG. 5 cold packs are introduced through a lid 18 that forms an upper wall of the apparatus. Cold packs 35 are introduced through lid 18 and a further hatch 32 that covers an access aperture to the cold pack storage volume 30. The lid 18 allows access to the payload compartment 12 as well as the hatch 32.

The apparatus 1T otherwise has a similar arrangement of pack storage volume 30, fluid reservoir 14 and payload compartment 12 to the embodiment of FIG. 2 except that a portion of the fluid reservoir 14 also forms a basal platform for items stored in the payload compartment 12. The reservoir 14 is substantially L-shaped, having a head region 14H and body region 14B below the head region. However a lower portion of the body region 14B of the reservoir 14 extends laterally to define a platform portion 14P that provides a lower internal surface of floor of the payload compartment 12. The platform portion 14P has recessed regions 14PR sized to receive items for storage such as beverage bottles 12B. It is to be understood that cooling of fluid in the body region 14B of the reservoir 14 results in cooling of fluid in the platform portion 14P, by conduction and/or displacement, resulting in cooling of bottles 12B provided in the recessed regions 14PR.

FIG. 6 illustrates a further variation of the fluid reservoir of the embodiment of FIG. 2. It is to be understood that if the apparatus 1 of FIG. 2 is moved in use, undesirable mixing of liquid in the body and head regions 14B, 14H may occur due to circulation of liquid caused by movement of the apparatus 1. The movement may cause liquid in the body region 14B to fall below the critical temperature due to mixing with liquid from the head region 14H. This may cause the temperature within the payload compartment 12 to fall at least temporarily below a minimum allowable temperature for an article stored therein, such as a vaccine.

Accordingly, in some embodiments baffle elements are provided for constraining movement of fluid in the fluid reservoir 14. The baffle elements are in some embodiments formed to have relatively low thermal resistance such that flow of thermal energy through a thickness of a baffle element may occur readily, i.e. flow through a baffle element between fluid on opposite sides of a baffle element. However in some embodiments at least some of the baffle elements are arranged such that a thermal resistance of a baffle element to flow of thermal energy along a baffle element is relatively low whilst still presenting a relatively low resistance to flow of thermal energy from one side of a baffle element to the other. This may be accomplished in some embodiments by means of a plastics material having a relatively low thermal conductivity but provided in sheet form. The sheet may be made sufficiently thin to provide a sufficiently low thermal resistance to heat passing through the sheet whilst still presenting a relatively high resistance to flow in a direction along the sheet. In some embodiments it may be desirable for one or more baffle elements or portions thereof to have a relatively high resistance to flow of thermal energy therethrough, i.e. from fluid on one side of an element to fluid on the opposite side of the element. In some embodiments one or more baffle elements may be arranged to have relatively low resistance to flow of thermal energy therethrough and therealong.

In the embodiment 1V of FIG. 6(*a*) substantially vertical baffle elements 51 are provided, disposed to run from upper to lower walls 14U, 14L of the fluid reservoir 14. In the embodiment shown apertures 14A are provided in the upper and lower regions of the baffle elements 51 to allow limited flow of fluid between regions defined by the baffle elements 51, which are referred to herein as cellular cavities or cells 14C. The cells 14C are therefore open cells in the embodiment of FIG. 6(*a*), i.e. cells in which fluid may flow into or out from a cell 14C through the apertures 14A. In some alternative embodiments one or more sealed cells are provided, being cells for which fluid may not flow into or out from the cell 14C. Examples of sealed cells will be discussed in more detail below, although it is to be understood that the cells described with respect to FIG. 6(*a*) to (*c*) may be sealed with liquid therein in some embodiments. In some embodiments having sealed cells, a user may not be required to provide their own fluid to fill the cells. That is, the cells may be filled and sealed during a process of manufacture of the apparatus. However, a requirement for a user to provide their own fluid may be advantageous since the apparatus 1 may be lighter to transport when the reservoir 14 is substantially empty of liquid.

In some embodiments the apertures 14A facilitate convenient filling of cells 14C of the reservoir 14 with liquid, and assist in accommodating expansion and contraction of liquid in the reservoir 14 and any gas trapped above a surface of the liquid.

It is to be understood that because the baffle elements 51 have relatively low resistance to flow of thermal energy from one side of an element 51 to the other, operation of the apparatus 1V in the steady state will be similar to that of the apparatus 1 of FIG. 2.

FIG. 6(*b*) shows a further embodiment 1H similar to that of FIG. 6(*a*) except that baffle elements 53 are disposed to run substantially horizontally between lateral side walls 16, 20. In this embodiment, flow of thermal energy through an element 53 parallel to a plane of the element 53 is typically not problematic since in the embodiment of FIG. 2 a thermal gradient to cause cooling of the payload container is typically established from the head region 14H to a base of the body region 14B.

In the embodiment of FIG. 6(*b*) the cells 14C may be considered to be 'stacked' on top of one another. As shown in FIG. 6(*b*), apertures 14A are provided in the baffle elements 53 that are alternately disposed towards opposite walls 16, 20 of the apparatus 1H in order to impede flow of fluid from a cell 14C in an upper region of the reservoir 14 to a cell 14C in a lower region whilst still allowing convenient filling of the reservoir 14. In some embodiments one or more of the baffle elements 53 may be tilted, such that it or they are disposed at a non-zero angle to the vertical and horizontal. This feature may be helpful in promoting expulsion of any gas that may be present in or form in a cell 14C and which might otherwise become trapped.

It is to be understood that fluid in the head region 14H that is cooled by the heat exchange plate 34 may cool fluid in the body region 14B below the head region 14H by conduction through the baffle elements 53. Fluid in a volume between baffle elements 53 may therefore be cooled by the upper baffle element 53, sink to the lower baffle element 53 and cause cooling of liquid immediately below the lower baffle element 53, and so forth. Eventually, substantially static equilibrium conditions may be attained in some embodiments. In some embodiments substantially static equilibrium conditions may be attained in which fluid within one or more baffle elements 53 remains substantially static whilst transfer of thermal energy between elements 53 takes place by conduction through the fluid.

FIG. 6(*c*) shows a still further embodiment 1C of the present invention in which both horizontal and vertical baffle elements 51, 53 are provided. The elements 51, 53 in the embodiment shown define substantially elongate cellular cavities 14C in which fluid is provided. This embodiment may be suited to particularly harsh environments in which relatively severe and frequent agitation of the apparatus 10 may be expected. It is to be understood that thermal conduction through the baffle elements 51, 53 between fluid in adjacent cellular cavities 14C may allow operation of the apparatus 10 in a similar manner to that of the apparatus of FIG. 2 except that a distance fluid may rise or fall is constrained by the horizontal elements 53, whilst lateral flow of fluid along a direction normal to the vertical elements 51 is constrained by the vertical elements 51. In the embodiment of FIG. 6(*c*) two mutually orthogonal sets of elements 51, 53 are provided, elements 51, 53 of a given set being substantially parallel to one another. In some alternative embodiments a third set of mutually parallel elements are provided, the third set being substantially orthogonal to elements of the other two sets 51, 53. In such an arrangement the first, second and third set of baffle elements may be spaced by substantially equal amounts such that the cellular cavities 14C are substantially cubic in shape.

In some embodiments baffle elements may be provided having a substantially honeycomb-shaped arrangement. The baffle elements may be oriented to allow movement of fluid along a longitudinal axis of a given cell. The longitudinal axis may be oriented substantially parallel to a horizontal axis of the reservoir 14, a vertical axis, or be inclined at an angle between vertical and horizontal axes such as an angle of substantially 45 degrees, with respect to a normal upright orientation. Other arrangements may be useful.

In some embodiments the baffle elements are formed from thermally conductive material and arranged such that if a temperature in the head region 14H of the fluid reservoir 14 falls below a prescribed value, liquid in contact with one or more upper portions of the baffle elements may freeze on a baffle element thereby restricting flow of fluid within the baffle element. This may be arranged in turn to limit a rate of cooling of an article cooled by the reservoir 14 such as payload compartment 12 in some embodiments. This may assist in preventing overcooling of an article such as an article in a payload compartment 12.

It is to be understood that in some embodiments the fluid reservoir 14 may contain a plurality of fluid-filled envelopes or capsules that are in thermal communication with one another, for example by being provided in direct contact with one another. The envelopes may be sealed in a substantially fluid-tight manner, for example hermetically sealed, and capable of accommodating expansion and contraction of fluid provided therein, as required. Examples of such embodiments will now be described.

A process of fabricating fluid-filled envelopes will now be described with reference to FIG. 7.

In a first of the three stages, two sheets 155*a*, 155*b* of a plastics film material are welded together by means of two orthogonal sets of parallel weld seams 155W as shown in FIG. 7(*a*) to form a composite sheet 155. The sheets 155*a*, 155*b* are welded together such that edge weld seams 155WE, being weld seams along three peripheral edges of the sheets 155*a*, 155*b* are substantially continuous seams whilst the remaining weld seams 155W, 155W' are discontinuous. The remaining seams 155W, 155W' are discontinuous in such a manner that a fluid flow path exists between a fluid inlet 155IN, being a feature provided along a fourth edge of the sheets 155*a*, 155*b* in the form of a discontinuity in a weld seam 155W' along that fourth edge, and each cell 114C.

In a second of the three stages the cells 114C are filled with fluid by introducing the fluid via the fluid inlet 155IN.

In a third of the three stages the weld seams 155W', 155W having a discontinuity may be subject to a further welding process in which the discontinuities are eliminated. This results in the formation of fluid-filled, sealed cells 114C which may also be referred to as 'fluid pockets'.

In an alternative embodiment, in the third stage only the edge weld seam 155W' with the inlet 1551N formed therein is re-welded. Optionally, the inlet is sealed by welding or other suitable method such as by means of an adhesive or mechanical fixing, without welding along substantially the whole of the length of the edge weld seam 155W' having the inlet 1551N formed therein.

The fluid-filled composite sheet 155 may then be introduced into the fluid reservoir 14. The composite sheet 155 may be introduced into the reservoir 14 instead of introducing fluid directly into the reservoir 14, or in addition to such fluid. It is to be understood that fluid introduced directly into the reservoir 14 will be in fluid communication with inner walls of the reservoir 14 whereas fluid in the sealed cells 114C of the composite sheet 155 may not in fluid communication with the walls of the reservoir 14 because it is enclosed by the sheets 155*a*, 155*b*.

In an embodiment, weld seams 155W', 155W are re-welded following filling of the composite sheet 155 with fluid, and the sheet 155 is cut along the weld seams 155W such that the fluid-filled cells 114C are separated from one another whilst remaining substantially fluid-tight. The resulting 'loose' cells 214C, illustrated in FIG. 7(*c*), may then be introduced into the reservoir 14 as shown in FIG. 7(*c*), again either instead of introducing fluid directly into the reservoir or in addition. In FIG. 7(*c*) the loose cells 214C are shown within the body region 14B of the reservoir 14.

It is to be understood that the provision of cells 114C in the form of cells such as a composite sheet 155 of cells or in the form of loose cells 214C may reduce undesirable mixing of fluid in the head and body regions 114H, 114B and fluid at different depths within the body region 114B. As explained above, undesirable mixing may occur for example due to agitation, for example due to vibrations, for example whilst being transported. In some embodiments the use of sealed cells 114C, 214C reduces a risk of fluid loss from the reservoir 14, for example due to a leak. A leak may be caused for example due to a crack in a wall of the reservoir 14. However, provided thermal contact between the cells 114C, 214C is adequate, a reservoir 14 filled with cells 114C, 214C where the cells contain a liquid having a suitable critical temperature, such as water, may function in a similar manner to a reservoir 14 filled with that liquid. As noted above the liquid may be any liquid having a suitable critical temperature such as water, a water mix such as a salt solution, a solvent or solvent mix such as water and a solvent, or an oil or any suitable combination thereof.

In some embodiments, cells 114C in the form of a composite sheet 155 or cells 214C in loose form may be provided within the pack storage volume 30 in addition to or instead of within the reservoir 14.

It is to be understood that the cells 14C, 114C, 214C may be arranged to have any suitable size or shape. In some embodiments, cells 14C, 114C, 214C may be provided in a given reservoir that have a plurality of different respective sizes.

For example, in the case of sealed cells 114C, 214C smaller cells 114C, 214C may be useful in filling gaps between larger cells 114C, 214C in some embodiments. In some embodiments cells 14C, 114C, 214C may be provided of different respective sizes as a function of distance within the reservoir 14. For example, in some embodiments relatively small cells may be provided in certain prescribed regions of the reservoir, with relatively large cells provided in other prescribed regions.

In some embodiments, the reservoir 14 may contain regions with different types of coolant. For example certain sealed cells may be provided with a certain coolant therein whilst other sealed cells have a different coolant therein. In some alternative embodiments at least some sealed cells may have a first coolant whilst the reservoir itself has a second, different coolant therein. The sealed cells may be immersed within the second coolant in the reservoir 14. One of the coolants may comprise an oil or other material that solidifies at a different temperature to the other coolant, for example at a temperature higher than the other coolant. The coolant solidifying at the higher temperature may be arranged to have a lower thermal conductivity when solidified. This may be arranged to increase a thermal resistance of a path from the head region 14H to one or more portions of the body region 14B, or a path within the body region 14B and/or the head region 14H, so as to reduce a risk that the body region 14B cools to an excessively low temperature. For example in the event that extreme cooling of the pack storage volume 30 takes place, over cooling of the body region 14B may be prevented.

In some embodiments, wherein convection of liquid in a cell is responsible at least in part for thermal transport across a cell, solidification of coolant in the cell may reduce thermal transport through the cell by substantially preventing or reducing an efficiency of transport by convection. For example, a thermal resistance of a cell containing solidified coolant may be higher than that of a cell containing coolant in liquid form at least in part for this reason.

In some embodiments a shape or size of a cell may be arranged to depend at least in part on a temperature of the cell. This may be employed in some embodiments to increase or reduce a rate of thermal transport within the reservoir 14 and/or storage volume 30 in dependence on temperature. In some embodiments one or more cells may be arranged to contract below a given temperature and reduce an area of thermal contact between cells, reducing an efficiency of cooling thereby to prevent a payload compartment 12 or other article from being cooled excessively. Other arrangements may be useful.

In some embodiments, expansion or contraction of a cell provided in the fluid reservoir may be used to effect a flow restriction of liquid between the head region 14H and body region 14B, or within the head or body regions 14H, 14B, in order to reduce cooling when a temperature of fluid in the reservoir 14 is particularly low. Again, this may assist in preventing over-cooling of a payload compartment 12 or other object cooled by the fluid reservoir 14.

Some embodiments of the present invention may also be useful in refrigeration apparatus for use in cooling an ambient environment of a building. Some embodiments may be useful for cooling articles such as an energy storage cell such as a battery. In some embodiments cooling apparatus according to an embodiment of the invention may be used to cool one or more batteries that form part of a telecommunications base station such as a remote base station. The one or more batteries may be provided in thermal communication with fluid in the fluid reservoir 14 by suitable heat exchange means. The heat exchange means may include a system employing liquid coolant that is cooled by liquid in the fluid reservoir 14 to draw heat from the one or more batteries. In addition or instead, the heat exchange means may employ gas such as air that is cooled by liquid in the fluid reservoir 14 and used to cool the one or more batteries. The heat exchange means may comprise a fluid conduit arranged in thermal communication with the body region 14B of the reservoir 14.

The above described embodiments represent advantageous forms of embodiments of the invention but are provided by way of example only and are not intended to be limiting. In this respect, it is envisaged that various modifications and/or improvements may be made to the invention within the scope of the appended claims.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. A cooling apparatus comprising:

a cold store portion for storing at least one cooling element;

a fluid reservoir, the reservoir having a head region and a body region below the head region each arranged, in use, to contain a fluid to be cooled;

a cold store heat exchange portion interposed between the at least one cooling element and the headspace of the fluid reservoir and enabling thermal communication between the at least one cooling element and the fluid in the head region of the fluid reservoir; and a payload heat exchange portion interposed between the body region of the fluid reservoir and an opposing side of the payload heat exchange portion and enabling thermal communication between the fluid in the body region and the opposing side of the payload heat exchange portion.

2. The apparatus according to claim 1, wherein the payload heat exchange portion and cold store portion are positioned on substantially opposite sides of the fluid reservoir.

3. The apparatus according to claim 2, arranged wherein in use the payload heat exchange portion is provided in substantially direct thermal contact with the fluid in the fluid reservoir below the head region and not with fluid within the head region.

4. The apparatus according to claim 1, further comprising:

a payload container, wherein in use the opposing side of the payload heat exchange portion is arranged to allow flow of thermal energy from an interior volume of the payload container to the fluid in the body region of the fluid reservoir.

5. The apparatus according to claim 1, wherein the cold store heat exchange portion is arranged, in use, to be substantially direct thermal contact with a cooling element in the cold store portion.

6. The apparatus according to claim 1, wherein the cold store portion is sized to receive a plurality of cold packs.

7. The apparatus according to claim 5, further comprising:

resilient urging means for maintaining the cooling element in substantially direct thermal contact with the cold store heat exchange portion.

8. The apparatus according to claim 7, wherein the resilient urging means comprises a spring mechanism arranged to provide physical force to the cooling element thereby urging the cooling element up against the cold store heat exchange portion.

9. The apparatus according to claim 1, wherein a head volume of the head region is greater than a body volume of the body region.

10. The apparatus according to claim 9, wherein the body region and the head region of the fluid reservoir are constructed as discrete volumes with an overlapping intersection.

11. The apparatus according to claim 1, wherein the fluid storage reservoir further comprises:

a plurality of fluid-filled cells in thermal contact with one another, each cell comprising fluid contained within a cell wall, the cell walls of respective adjacent cells being arranged to allow transfer of thermal energy between fluid in respective adjacent cells in thermal contact.

12. The apparatus according to claim 11, wherein the plurality of cells substantially fill the volume of the fluid reservoir.

13. The apparatus according to claim 1, wherein the fluid reservoir further comprises an internal wall arranged to divide the reservoir into compartments.

14. The apparatus according to claim 13, wherein the at least one internal wall has a sufficiently low thermal resistance to allow thermal equilibration of fluid on opposite respective sides of the internal wall.

15. The apparatus according to claim 13, wherein the at least one internal wall is thermally insulating.

16. The apparatus according to any one of claim 13, wherein the compartments are in fluid isolation from one another.

17. The apparatus according to any one of claim 13, wherein at least two compartments are in fluid communication with one another.

18. The apparatus according to claim 1, wherein the fluid reservoir contains a thermal fluid having a critical temperature, the critical temperature being a temperature at which the thermal fluid has the greatest density, and the thermal fluid remains in the fluid state both above and below the critical temperature.

19. The apparatus according to claim 1 wherein the cooling element comprises a powered refrigeration unit or element.

* * * * *